US008031145B2

(12) United States Patent
Takatori

(10) Patent No.: US 8,031,145 B2
(45) Date of Patent: Oct. 4, 2011

(54) LIQUID CRYSTAL DISPLAY DEVICE AND METHOD OF DRIVING SAME

(75) Inventor: Kenichi Takatori, Tokyo (JP)

(73) Assignee: NEC Corporation, Tokyo (JP)

( * ) Notice: Subject to any disclaimer, the term of this patent is extended or adjusted under 35 U.S.C. 154(b) by 1097 days.

(21) Appl. No.: 11/074,767

(22) Filed: Mar. 9, 2005

(65) Prior Publication Data

US 2005/0200589 A1 Sep. 15, 2005

(30) Foreign Application Priority Data

Mar. 11, 2004 (JP) ..... 2004-069610

(51) Int. Cl.
*G09G 3/36* (2006.01)

(52) U.S. Cl. ..... 345/87; 345/98

(58) Field of Classification Search ..... 345/87–100; 349/72, 76, 179, 101–103, 121, 130, 134, 349/136, 151
See application file for complete search history.

(56) References Cited

U.S. PATENT DOCUMENTS

| | | | | |
|---|---|---|---|---|
| 4,033,671 | A * | 7/1977 | Berreman | 349/181 |
| 4,394,070 | A * | 7/1983 | Brown et al. | 349/165 |
| 6,620,467 | B2 * | 9/2003 | Sudo et al. | 428/1.1 |
| 6,825,821 | B2 * | 11/2004 | Oda et al. | 345/87 |
| 6,992,650 | B2 * | 1/2006 | Takei et al. | 345/89 |
| 7,365,721 | B2 * | 4/2008 | Tanaka et al. | 345/87 |
| 2002/0057246 | A1 * | 5/2002 | Okita | 345/87 |
| 2002/0109660 | A1 * | 8/2002 | Fukunaga | 345/92 |
| 2004/0160404 | A1 * | 8/2004 | Nakajima et al. | 345/96 |

FOREIGN PATENT DOCUMENTS

| | | | |
|---|---|---|---|
| CN | 1336413 | A | 2/2002 |
| CN | 1351324 | A | 5/2002 |
| CN | 1432847 | A | 7/2003 |
| JP | 2-113294 | A | 4/1990 |
| JP | 3039506 | | 3/2000 |
| JP | 2002-175057 | A | 6/2002 |
| WO | WO-98/27538 | A | 6/1998 |
| WO | WO-03/094141 | A1 | 11/2003 |

OTHER PUBLICATIONS

H. Nakamura, et al.; "Modified Drive Method for OCB LCD"; 1997 IDRC (International Display Research Conference), SID L-66-L-69.
"Liquid Crystal Dictionary"; Japan Society for the Promotion of Science, Organic Materials for Information Science, 142nd Committee, Sectional Meeting on Liquid Crystal, Baifukan Co., Ltd., p. 24, Apr. 26, 1990.
Kazuaki Tarumi, et al.; "On the Flow Effect of Super Twisted Nematic Cells"; Molecular Crystals and Liquid Crystals; 1995; vol. 263; pp. 459-467.

* cited by examiner

*Primary Examiner* — Kevin Nguyen
*Assistant Examiner* — Kenneth B Lee, Jr.
(74) *Attorney, Agent, or Firm* — Dickstein Shapiro LLP

(57) ABSTRACT

In a liquid crystal display device which uses an electric field whereby a sufficient reset effect or sufficient overdrive effect is obtained at a lower-limit temperature at which the device is used, but which does not produce bounce at normal temperatures, the electric field applied has an intensity greater than that of an electric field at which a 99% response is obtained, and less than that of an electric field at which a 99.9% response is obtained, between a white image and a black image at the lower-limit temperature at which the device is used. Alternatively, the electric field applied has an intensity greater than that of an electric field at which average tilt angle of the liquid crystal exceeds 81 degrees, and at which average tilt angle does not exceed 85 degrees.

29 Claims, 14 Drawing Sheets

CIRCUIT SIDE nch | CIRCUIT SIDE pch | PIXEL SWITCH nch | HOLDING CAPACITOR

LIQUID CRYSTAL DISPLAY DEVICE AND METHOD OF DRIVING SAME

FIELD OF THE INVENTION

This invention relates to a display device having a liquid crystal display element and to a method of driving the device and, more particularly, to a display device having a nematic liquid crystal display element usable over a wide range of temperatures, and to a method of driving the display device.

BACKGROUND OF THE INVENTION

With the progression of the multimedia era, various types of liquid crystal display devices, from a small one used in a projector device, a cellular phone, a viewfinder, and the like to a large one used in a notebook PC, a monitor, a television, and the like, have rapidly become widespread. A medium-sized liquid crystal display device has become essential in electronic equipment such as a viewer and a PDAs (Personal Digital Assistants) and in amusement devices such as portable game machines and pachinko (Japanese pinball game) machines. These liquid crystal display devices find use in a variety of locations even in such appliances as refrigerators and microwave ovens.

At present, almost all liquid crystal display elements are of the twisted nematic (referred to as "TN" below) display type. A liquid crystal display element of the TN display type utilizes a nematic liquid crystal substance. If a conventional TN cell is subjected to direct matrix drive, display quality is not very high and the number of scan lines is limited. Accordingly, if direct matrix drive is adopted, use is made mainly of liquid crystal of the STN (Super Twisted Nematic) type, rather than of the TN type. Liquid crystal of this type exhibits improved contrast and viewing angle dependence in comparison with early direct matrix drive employing TN-type liquid crystal. Since the speed of response is low, however, this approach is not suited to display of moving pictures.

In order to improve upon the display performance afforded by direct matrix drive, an active matrix scheme in which each pixel is provided with a switching element has been developed and is now in wide use. By way of example, TN-TFT-type liquid crystal generally is used. Such a liquid crystal cell employs a thin-film transistor (TFT) in a TN-type display scheme. Since an active matrix scheme using a TFT provides a display quality higher than that obtained with direct matrix drive, TN-TFT liquid crystal presently dominates the market.

Owing to demand for ever-higher image quality, methods that provide an improved viewing angle have undergone research and development and some of these methods are in practical use. As a result, high-performance liquid crystal displays that are primarily in use at the present time are TFT-type active matrix liquid crystal displays of the following three types:

- displays that employ a compensating film in a TN-type cell;
- in-plane-switching (IPS) mode displays; and
- multidomain vertically aligned (MVA) mode displays.

In order to perform positive and negative write using a 30-Hz image signal in these active matrix liquid crystal display devices, rewriting is carried out every 60 Hz and the duration of one field is about 16.7 ms (the total time of both positive and negative fields is referred to as one frame and is about 33.3 ms).

By contrast, the response speed of liquid crystal at the present time is on the order of this frame period even in a fastest condition when one considers the response during display of halftones. This means that a response speed faster than the present frame period is necessary when an image signal comprising a moving picture is to be displayed, when high-speed computerized images (computer graphics) are displayed, and when a high-speed game image is displayed.

On the other hand, mainstream pixel size at present is on the order of 100 ppi (pixels per inch), and higher definition is contemplated using the following two methods:

The first method is to raise machining precision to reduce pixel size.

The second method is to employ a field-sequential (time-division) color liquid crystal display device in which backlighting for illuminating the liquid crystal display is changed over to red, green and blue in time-wise fashion and red, green and blue images are displayed in sync with this changeover. This approach makes possible a three-fold increase in definition over the prior art since it is unnecessary to spatially dispose color filters.

With a field-sequential liquid crystal display device, it is necessary to display single color for one-third time of the single field, and therefore the time available for display is about 5 ms. Accordingly, it is required that the liquid crystal itself have a response faster than 5 ms.

Owing to the necessity for such high-speed liquid crystal, a various technologies have been studied and several high-speed display mode technologies have been developed. These high-speed liquid crystal technologies can be classified generally into two major trends.

The first consists of technologies for raising the speed of the above-mentioned nematic liquid crystal most widely in use.

The second consists of technologies using spontaneous-polarization smectic liquid crystal that exhibits spontaneous polarization and can respond at high speed.

The speedup of nematic liquid crystal, which is that in widest use, is mainly carried out by the following means:

(A) reducing the cell gap and increasing electric field intensity at the same voltage;

(B) applying a high voltage to raise field intensity and facilitating a change in state (this is an overdrive method);

(C) lowering viscosity; and (D) using a mode considered to be a high-speed mode in principle.

The following problems arise even with such nematic liquid crystal of elevated speed:

Since response of liquid crystal ends substantially in one frame in the case of a high-speed nematic liquid crystal, there is very large change in the capacitance of the liquid crystal layer ascribable to anisotropy of the dielectric constant. Owing to the change in capacitance, a change occurs in holding voltage to be written to and retained in the liquid crystal layer. This change in holding voltage, i.e., a change in the effective applied voltage, results in insufficient writing and therefore lowers contrast.

Further, if the same signal continues to be written, luminance continues changing until the holding voltage no longer changes and several frames become necessary in order to obtain stable luminance.

In order to prevent such a response that necessitates several frames, it is necessary that one-to-one correspondence be established between the applied signal voltage and the transmittance obtained.

With active matrix drive, transmittance after the liquid crystal responds is decided not by the applied signal voltage but by the amount of electric charge that has accumulated in the liquid crystal capacitor after the liquid crystal responds.

The reason for this is that active matrix drive is constant-charge drive that causes the liquid crystal to respond by the electric charge held.

If minute leakage and the like are ignored, the amount of electric charge supplied from an active element is decided by accumulated charge that prevailed prior to predetermined signal write, and newly written charge.

Further, accumulated charge after the liquid crystal has responded varies depending upon the physical constants of the liquid crystal, the electrical parameters thereof and pixel design values such as accumulation capacity. In order to establish one-to-one correspondence between applied signal voltage and transmittance, therefore, the following are required:

(A) correspondence between signal voltage and write charge;

(B) accumulated charge prior to write; and (C) information for performing calculation of accumulated charge after response, as well as the actual calculation.

The above necessitates a frame memory for storing (B) over the entire screen and a calculation unit for (A) or (C).

A reset pulse method of applying a reset voltage to bring liquid crystal to a predetermined liquid crystal state is one method of establishing one-to-one correspondence between applied signal voltage and obtained transmittance without using the above-mentioned frame memory and calculation unit, and this method is often employed. An example of this method is described in the prior art set forth in H. Nakamura, K. Miwa and K. Sueoka, "Modified drive method for OCB LCD", 1997 IDRC (International Display Research Conference), SID L-66-L-69 (Non-Patent Document 1). According to this reference, use is made of an OCB (Optical Compensated Birefringence) mode in which orientation of nematic liquid crystal is made a pi-shaped orientation and a compensating film is applied.

Response speed of this liquid crystal mode is approximately 2 to 5 ms, which is much faster than the conventional TN mode. As a result, response should end in one frame. As mentioned above, however a large-scale decline in holding voltage occurs owing to a change in dielectric constant ascribable to the response of the liquid crystal, and several frames are needed to obtain stable transmittance.

A method of writing a black image without fail following the writing of a white image in one frame is indicated in FIG. 5 of Non-Patent Document 1. The diagram of FIG. 5 of this reference is cited as FIG. 13 in the drawings accompanying this application. In FIG. 13, time is plotted along the horizontal axis and luminance along the vertical axis. The dashed line in FIG. 13 indicates a change in luminance in the case of ordinary drive. A stable luminance is reached is the third frame.

In accordance with the reset pulse method, a predetermined state is always obtained when new data is written and therefore one-to-one correspondence between a written constant signal voltage and constant transmittance. Owing to this one-to-one correspondence, the generation of a driving signal becomes very simple and means such as a frame memory for storing the previously written information becomes unnecessary.

The structure of a pixel in a liquid crystal display device of active matrix type will now be described.

FIG. 10 illustrates an example of a pixel circuit for one pixel in a conventional liquid crystal display device of active matrix type. As shown in FIG. 10, the pixel of the liquid crystal display device comprises a MOS transistor Qn (referred to simply as "transistor Qn" below) having its gate electrode connected to a scan line (or scanning signal electrode) 901, either its source electrode or drain electrode connected to a signal line (or image signal electrode) 902, and the other of these source and drain electrodes connected to a pixel electrode 903; a storage capacitor 906 formed between the pixel electrode 903 and a storage capacitor electrode 905; and liquid crystal 908 sandwiched between the pixel electrode 903 and an opposing electrode (or common electrode) Vcom 907.

In notebook personal computers that constitute a large part of the market for liquid crystal displays, an amorphous silicon thin-film transistor (referred to as an "a-Si TFT below) or polycrystalline silicon thin-film transistor (referred to as a "p-Si TFT") usually is used as the transistor (Qn) 904, and NT liquid crystal is employed as the liquid crystal material.

FIG. 11 illustrates an equivalent circuit of a TN liquid crystal cell. As shown in FIG. 11, the equivalent circuit of a TN liquid crystal cell is expressed by a circuit in which a capacitor component C3 (electrostatic capacitance Cpix thereof) of the liquid crystal is connected in parallel with a resistance value Rr of a resistor R1 and a capacitor C1 (electrostatic capacitance Cr thereof). In this equivalent circuit, the resistance value Rr and electrostatic capacitance Cr are components that decide the response time constant of the liquid crystal.

FIG. 12 illustrates a timing chart of scan line voltage Vg, signal line voltage (or image signal voltage) Vd and voltage Vpix of the pixel electrode 903 (referred to as "pixel voltage" below) in a case where the above-mentioned TN liquid crystal is driven by the pixel circuit shown in FIG. 10.

As shown in FIG. 12, the scan line voltage Vg attains a high level VgH during the horizontal scanning period. As a result, the transistor (Qn) 904 is in the ON state during this period and the signal line voltage Vd being input to signal line 902 is transferred to the pixel electrode 903 through the transistor (Qn) 904. The TN liquid crystal normally operates in a mode in which light passes through when no voltage is applied. This is a so-called "normally white mode".

In the example shown in FIG. 12, the voltage for increasing optical transmittance through the TN liquid crystal is applied across several fields as the signal line voltage Vd. When the horizontal scanning period ends and the scan line voltage Vg reverts to the low level, the transistor (Qn) 904 reverts to the OFF state and the signal line voltage that has been transferred to the pixel electrode 903 is held by the storage capacitor 906 and capacitance Cpix of the liquid crystal. The pixel voltage Vpix at this time gives rise to a voltage shift, which is referred to as a "field-through voltage", via the gate-source capacitance of the transistor (Qn) 904 at the moment the transistor (Qn) 904 attains the OFF state.

This voltage shift is indicated at Vf1, Vf2 and Vf3 in FIG. 12. The amount of the voltage shifts Vf1 to Vf3 can be reduced by designing the storage capacitor 906 to have a large value.

In the next field period, the pixel voltage Vpix is held until the scan line voltage Vg attains the high level again and the transistor (Qn) 904 is selected. The TN liquid crystal is switched in accordance with the held pixel voltage Vpix, and the light transmitted through the liquid crystal shifts from the dark state to the bright state as indicated by optical transmittance T1 in FIG. 12.

In the holding period at this time, the pixel voltage Vpix fluctuates by ΔV1, ΔV2, ΔV3 in each field, as illustrated in FIG. 12. This is caused by the fact that the capacitance of the liquid crystal varies in accordance with the response of the liquid crystal. The storage capacitor 906 usually is designed to have a large value that is two, three or more times greater than the pixel capacitance Cpix so as to make this fluctuation as small as possible. The TN liquid crystal can be driven by the pixel circuit shown in FIG. 10 by adopting the arrangement described above.

A technique for modulating the common voltage [common electrode voltage (or opposing electrode voltage)], which is illustrated in Japanese Patent Kohyo Publication No. JP-P2001-506376A (Patent Document 1), is an example of a technique having an effect that is the result of mixing the overdrive method and reset method. FIG. 2C of this reference is cited as FIG. 14 in the drawings accompanying this application.

According to the technique of Patent Document 1, ordinarily a common voltage, which is the voltage of a common electrode placed opposite a pixel electrode, is modulated. In FIG. 14, VCG indicates a temporal change in the common voltage (VCG), and an underlying waveform I indicates a temporal change in optical transmittance ascribable to response of the liquid crystal. That is, a voltage waveform 151 is a voltage waveform that is applied to the common electrode, and a light-intensity waveform 152 is a light-intensity waveform corresponding to time and conforming to the waveform 151. Reference numerals 153 to 156 denote curves of pixel light intensity.

With the prior art that preceded Patent Document 1 cited above, drive was performed with the common voltage held at a constant value [where t0 to t2 (and t2 to t4) in FIG. 14 serves as the period of one frame], or common inversion drive, in which the voltage value is varied between two voltage values at a fixed interval.

According to Patent Document 1, one frame period is divided into two parts and voltage having an amplitude substantially the same as that of conventional common inversion drive is applied in the interval from t1 to t2 (and from t3 to t4).

In the interval from t0 to t1 (and from t2 to t3) in one frame period, on the other hand, a voltage higher than the amplitude of common inversion (e.g., a voltage that is higher than the amplitude of common inversion by an amount equivalent to the voltage at the time of the black image) is applied. According to this technique, the entire display area can be changed to the black image rapidly owing to the effect of an enlarged voltage difference between the pixel electrode and common electrode in the interval from t0 to t1 over which the high voltage is applied to the common electrode. In other words, drive equivalent to reset drive is carried out.

Furthermore, even if image data is written into the pixel electrode during the interval from t0 to t1, the potential difference between the pixel electrode and common electrode is sufficiently large (e.g., greater than the black image voltage) and therefore nothing is observed on the display.

After the writing of image data to the entire display area ends, the voltage of the common electrode is returned to the amplitude of common inversion. As a result, the liquid crystal layer starts responding to change the transmittance, which conforms to each gray level, in accordance with the voltage memorized by the pixel electrode. That is, when response starts, there is a change from the state of high voltage difference to a voltage difference that conforms to each gray-le v el voltage value. In this sense a kind of overdrive is performed in the interval from t0 to t1.

Note that the response time of liquid crystal is given by the following two equations (1) and (2) (see "Liquid Crystal Dictionary", Japan Society for the Promotion of Science, Organic Materials for Information Science, 142$^{nd}$ Committee, Sectional Meeting on Liquid Crystal, Baifu K. K., p. 24) (Non-Patent Document 2). Specifically, rise response (ON-time response) $\tau_{rise}$ at which a voltage higher than a threshold-value voltage is applied and the ON state attained is given by Equation (1) below.

$$\tau_{rise} = \frac{d^2 \cdot \tilde{\eta}}{\Delta\varepsilon \cdot (V^2 - V_c^2)} \tag{1}$$

On the other hand, decay response (OFF-time response) $\tau_{decay}$ at which the applied voltage greater than the threshold value returns rapidly to zero is given by Equation (2) below.

$$\tau_{decay} = \frac{d^2 \cdot \tilde{\eta}}{\pi^2 \cdot \tilde{K}} \tag{2}$$

In Equations (1) and (2) above, d represents the thickness of the liquid crystal layer, η the rotational viscosity, $\Delta_\epsilon$ the dielectric anisotropy, V the applied voltage conforming to each gray level, Vc the threshold voltage, and K() a constant based upon a Frank elastic constant. In the TN mode, the constant K is given by Equation (3) below.

$$\tilde{K} = K_{11} + \frac{1}{4}(K_{33} - 2 \cdot K_{22}) \tag{3}$$

In Equation (3) above, $K_{11}$, $K_{22}$ and $K_{33}$ represent elastic constants of splay, twist and bend, respectively.

With the rise response (ON-time response), the response time of the liquid crystal depends upon the reciprocal of the square of the value of the voltage applied, as will be understood from Equation (1). In other words, the response time of the liquid crystal depends upon the reciprocal of the square in accordance with a voltage value that differs for every gray level. Depending upon the gray level, therefore, response time differs widely, and if there is a voltage difference that is ten times larger, then the difference in response time will be 100 times larger.

On the other hand, in accordance with Equation (2), a disparity in response time ascribable to the gray level exists even with the decay response (OFF-time response) but the disparity falls within the range of a two-fold increase.

Turning to Non-Patent Document 2, a higher speed is achieved owing to the overdrive effect of applying a very high voltage at the time of the rise response (ON-time response).

Further, since the response used in actual image display becomes the entire decay response (OFF-time response), dependence upon the gray level is very small. As a result, a substantially equal response time is obtained over all gray levels.

[Patent Document 1]

JP Patent Kohyo Publication No. JP-P2001-506376A

[Patent Document 2]

JP Patent No. 3039506

[Non-Patent Document 1]

H. Nakamura, K. Miwa and K. Sueoka, "Modified drive method for OCB LCD", 1997 IDRC (International Display Research Conference), SID L-66-L-69

[Non-Patent Document 2]

"Liquid Crystal Dictionary", Japan Society for the Promotion of Science, Organic Materials for Information Science, 142$^{nd}$ Committee, Sectional Meeting on Liquid Crystal, Baifukan Co., LTD, p. 24

[Non-Patent Document 3]

Tarumi et al., "Molecular Crystals and Liquid Crystals", vol. 263, pp. 459 to 467 (Mol. Cryst. Liq. Cryst. 1995, Vol. 263, pp. 459-467

SUMMARY OF THE DISCLOSURE

The prior-art display devices described above, namely display devices that employ overdrive, display devices that rely upon reset drive and the display device disclosed in Patent Document 1 have several problems.

A first problem is that with the reset method, the display state varies greatly depending upon whether reset is excessive or inadequate. This problem also goes for the method described in Patent Document 1 that mixes the overdrive and reset methods in common.

First, if reset is excessive, start of optical response of the liquid crystal after reset is delayed or an abnormal optical response is observed before normal optical response begins.

The reason for this is that at the moment there is a transition from a predetermined orientation state, which has been attained by reset, to the normal response, the direction of operation at the time of response is not clear and a non-uniform or unstable response is made.

An example of an abnormal optical response is depicted in FIG. 3. As illustrated in FIG. 3, a response time of transmittance after reset is composed of three sections. Specifically, there are a first delay that appears at the beginning of the response, a second delay that occurs following the first delay, and a section ascribable to the normal response.

The abnormal optical response often is referred to as "bounce" because transmittance appears to bounce in conformity with the second delay. There are cases where delay due to bounce occurs and cases where it does not, depending upon the voltage application conditions. Usually, if a high voltage is applied, delay due to bounce occurs. Thus, if reset is excessive, a delay and a display abnormality occur.

If reset is inadequate, on the other hand, there are situations where the same transmittance is not obtained even though the same data is written multiple times. In a case where reset is inadequate, the predetermined orientation state is never completely achieved at reset and therefore the response after reset exhibits a transmittance that conforms to the history of the preceding frame. As a result, one-to-one correspondence no longer appears between the applied voltage and transmittance. Consequently, the desired gray level is no longer obtained and luminance varies greatly even when the same gray level is displayed.

A second problem is that it is difficult to obtain a display that is stable over a wide range of temperatures. The reason is that the speed of response of liquid crystal is highly dependent upon temperature.

In particular, with the reset method and the method described in Patent Document 1, the above-mentioned excessive or inadequate reset occurs in more pronounced fashion if temperature varies. The result is, e.g., a major decline in luminance at low temperatures. At high temperatures, on the other hand, the response speed between gray levels is increased, overall luminance rises and approaches a white image. A phenomenon that occurs, therefore, is a display that has a whitish appearance overall.

Accordingly, it is an object of the present invention to provide a liquid crystal display element with which an excellent display is obtained over a wide range of temperatures.

Another object of the present invention is to provide a liquid crystal display element in which, even if the element is used in a low-temperature environment, the image displayed will not depend upon the history of the preceding image and the colors of the image will not mix together.

According to one aspect of the present invention, the above and other objects are attained by providing a liquid crystal display device in which reset for temporarily returning orientation of the liquid crystal to a predetermined state is performed, an electric field intensity used in reset is made as an intensity at which sufficient reset is obtained at a lower-limit temperature at which the device is used, and is made as an intensity at which no bounce will occur in a response characteristic in the vicinity of room temperature.

Further, the electric field intensity used in reset may be a minimum intensity among intensities at which sufficient reset is obtained at the lower-limit temperature at which the device is used.

According to another aspect of the present invention, the foregoing objects are attained by providing a liquid crystal display device in which in a case where drive (overdrive) for raising speed of response is performed by applying an electric field greater than an electric field based upon a normal image signal across electrodes that operate a liquid crystal cell, the electric field intensity that is greater than the electric field based upon the normal image signal is an intensity at which a sufficient speed of response is obtained at a lower-limit temperature at which the device is used, and an intensity at which no bounce will occur in a response characteristic in the vicinity of room temperature. Further, the electric field intensity that is greater than the electric field based upon the normal image signal may be a minimum intensity among intensities at which a sufficient speed of response is obtained at the lower-limit temperature at which the device is used.

In the liquid crystal display of the present invention, the electric field used in reset is an electric field greater than an electric field at which a 95% response between a white image and a black image is obtained, and less than an electric field at which a 99.9% response between a white image and a black image is obtained, in an interval in which reset is performed. Preferably, the electric field used in reset is greater than an electric field at which a 99% response between a white image and a black image is obtained, and less than an electric field at which a 99.9% response between a white image and a black image is obtained.

Further, in the liquid crystal display of the present invention, maximum intensity of the electric field having an intensity greater than that of the electric field based upon the normal image signal is made greater than an intensity of an electric field at which a 95% response between a white image and a black image is obtained, and less than an intensity of an electric field at which a 99.9% response between a white image and a black image is obtained, in an interval in which the electric field having an intensity greater than the electric field based upon the normal image signal is applied. Preferably, maximum intensity of the electric field having an intensity greater than that of the electric field based upon the normal image signal is made greater than an intensity of an electric field at which a 99% response between a white image and a black image is obtained, and less than an intensity of an electric field at which a 99.9% response between a white image and a black image is obtained.

Alternatively, in the liquid crystal display of the present invention, the electric field used in reset is an electric field having an intensity greater than that of an electric field at which average tilt angle of the liquid crystal exceeds 75 degrees, and for which average tilt angle does not exceed 85 degrees, in an interval in which reset is performed. Preferably, the electric field used in reset is an electric field having an intensity greater than that of an electric field at which average tilt angle of the liquid crystal exceeds 81 degrees, and at which average tilt angle does not exceed 85 degrees.

Further, in the liquid crystal display of the present invention, maximum intensity of the electric field which has an intensity greater than that of the electric field based upon the normal image signal is larger than an intensity of an electric field at which average tilt angle of the liquid crystal exceeds 75 degrees, and for which average tilt angle does not exceed 85 degrees, in an interval in which the electric field that is greater than the electric field based upon the normal image signal is applied. Preferably, maximum intensity of the electric field which has an intensity greater than that of the electric field based upon the normal image signal is made greater than an intensity of an electric field at which average tilt angle of the liquid crystal exceeds 81 degrees, and at which average tilt angle does not exceed 85 degrees.

In accordance with the present invention, a liquid crystal display device having a high-speed response is realized. The reason for this is that bounce is not allowed to occur.

In accordance with the present invention, high reliability that makes an excellent display possible is obtained even if environmental temperature changes.

Still other objects and advantages of the present invention will become readily apparent to those skilled in this art from the following detailed description in conjunction with the accompanying drawings wherein only the preferred embodiments of the invention are shown and described, simply by way of illustration of the best mode contemplated of carrying out this invention. As will be realized, the invention is capable of other and different embodiments, and its several details are capable of modifications in various obvious respects, all without departing from the invention. Accordingly, the drawing and description are to be regarded as illustrative in nature, and not as restrictive.

DETAILED DESCRIPTION OF THE PREFERRED EMBODIMENTS OF THE INVENTION

Figure 3:
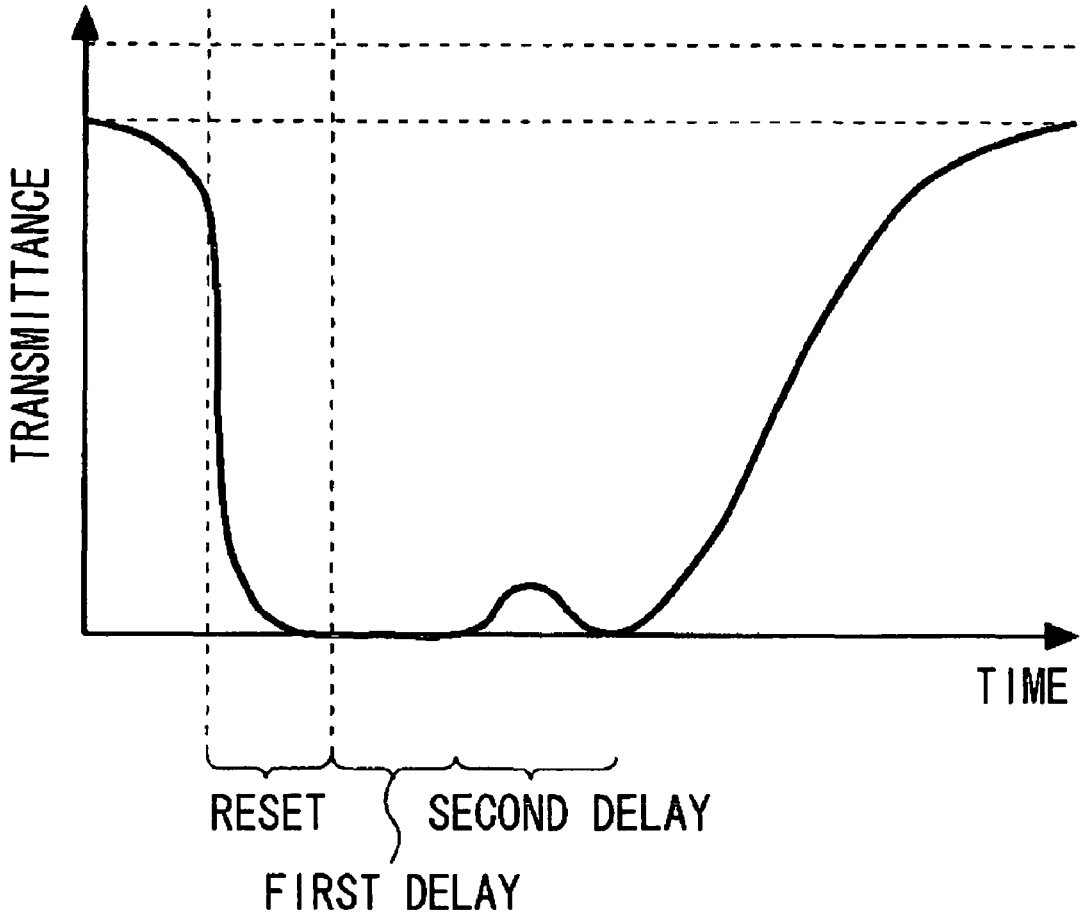
FIG. 3 is a graph illustrating an example of a temporal change in transmittance in a liquid crystal display device that employs reset.

The inventor has completed the present invention based upon findings obtained by closely analyzing a delay in the response of liquid crystal caused by reset as illustrated in FIG. 3. What the inventor has clarified by observing delay with great care is set forth below.

The delay that occurs at the transition from the reset state is of two types.

(A) The first type of delay is delay that occurs on account of the fact that in which direction the liquid crystal should respond is not decided quickly owing to fluctuations in the display substance per se when a transition is made from the reset state to another state. In the case of this delay, the optical state, such as the light transmitting or reflecting state, remains in a state substantially the same as the reset state. This is a time delay that lasts until a change in the optical state starts to occur.

The second type of delay is delay that occurs because the display substance responds temporarily in a direction other than the target direction, e.g., in the opposite direction, when a transition is made from the reset state to another state. In the case of this delay, the optical state, such as the light transmitting or reflecting state, differs from the reset state but a state different from the desired control state is produced. In order for the response to change from response in the different direction to response in the desired direction, there is a time delay that is longer than that of the first type of delay.

Further, a phenomenon that frequently occurs is that in a system in which the second type of delay occurs, the first type of delay also occurs simultaneously, thereby lengthening delay time even further.

The inventor has clarified by experimentation that the circumstances under which these delays occur vary when the temperature or applied voltage changes.

Figure 1:
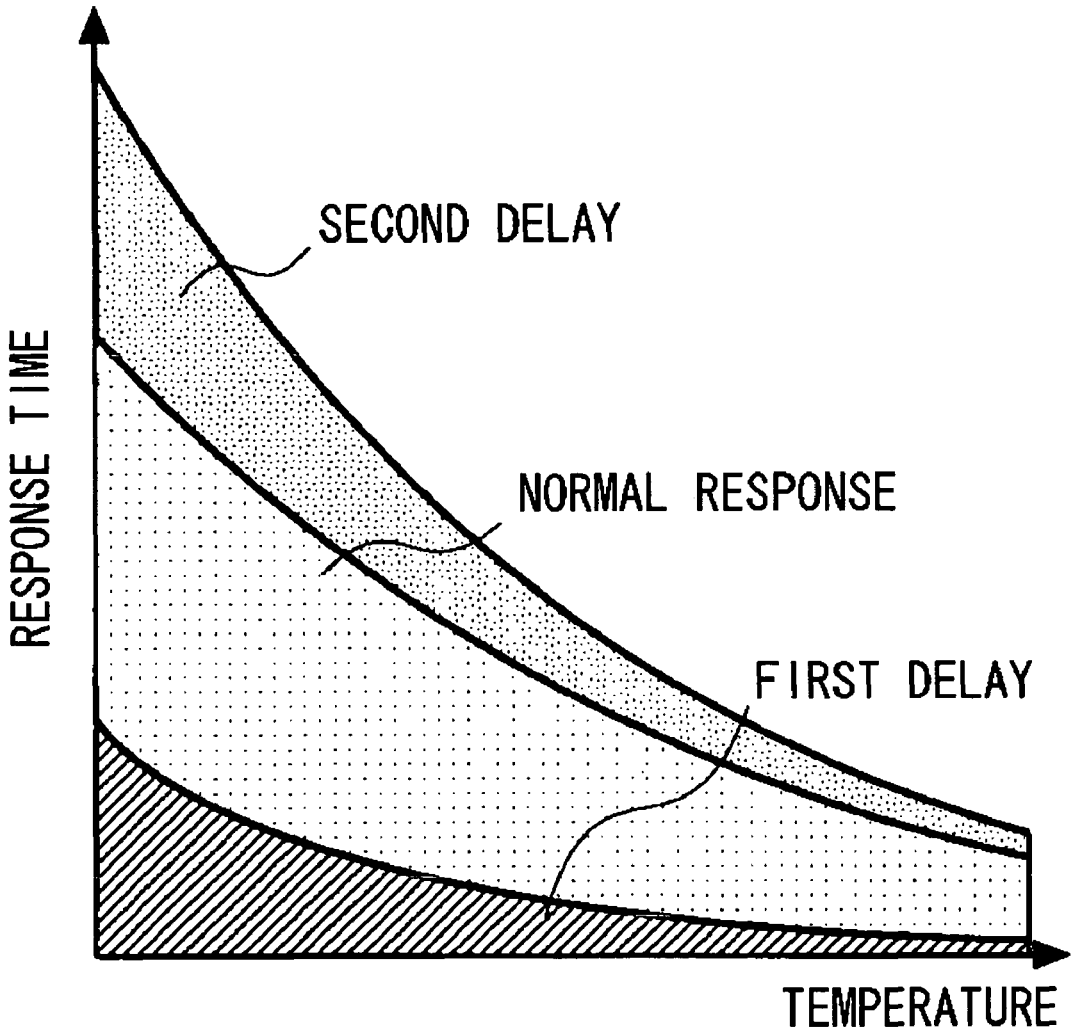
FIG. 1 is a graph useful in describing delays that fall within response time and a breakdown of time required for normal response when temperature is changed.

FIG. 1 is a graph illustrating delays that fall within response time and a breakdown of time required for normal response when temperature is changed in a liquid crystal display device in which conditions that give rise to both types of delay are maintained.

In FIG. 1, temperature is plotted along the horizontal axis and becomes successively higher from left to right. Response time is plotted along the vertical axis. When the temperature rises, the response of the liquid crystal speeds up and overall response time shortens. Ordinarily, the first and second delays have approximately the same delay times or the delay time of the second delay is somewhat longer, e.g., 1.2 times the delay time of the first delay. This relationship remains substantially unchanged even when the temperature is changed. Further, the time required for the normal response is approximately equal to the sum of the first and second delay times (though this relationship differs greatly depending upon operating mode of the liquid crystal).

The ratio between the time required for the normal response and each of the two delay times also remains substantially unchanged with respect to temperature. That is, the total delay time increases at lower temperatures.

Figure 2:
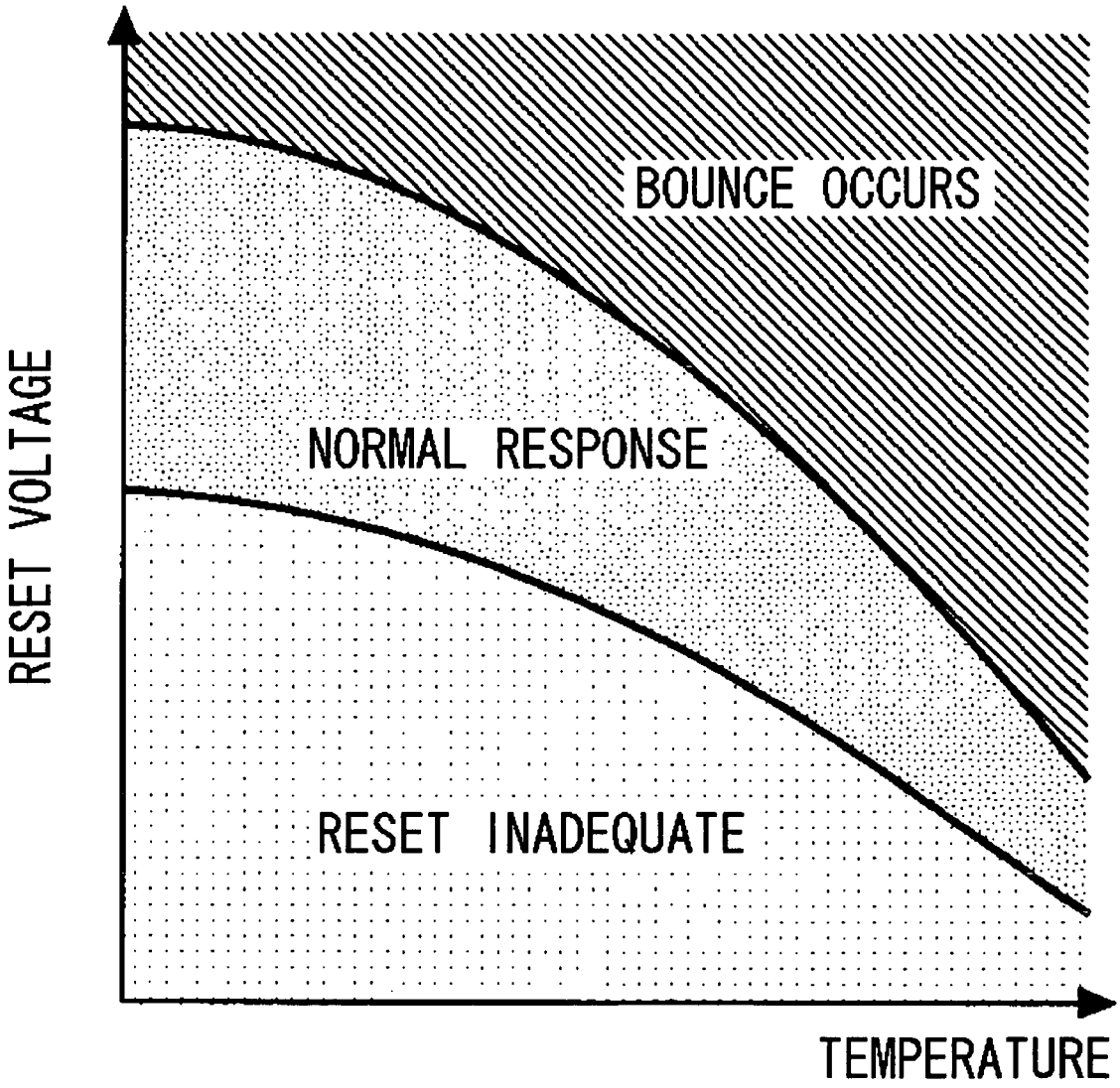
FIG. 2 is a graph useful in describing operation of a display device with respect to reset voltage and temperature in a liquid crystal display device that employs reset.

FIG. 2 is a graph illustrating operation of a display device with respect to reset voltage and temperature in a liquid crystal display device that employs reset. In FIG. 2, temperature is plotted along the horizontal axis and becomes successively higher from left to right. Reset voltage is plotted along the vertical axis; the higher the point along the vertical axis, the higher the voltage. When the reset voltage becomes too low, inadequate reset occurs and the display obtained is influenced by the preceding image. When the reset voltage becomes too high, on the other hand, bounce, which is the second delay, occurs and this brings about delayed response and a decline in transmittance attained. If the temperature drops, the inadequacy of reset becomes more prominent. If the temperature rises, the occurrence of bounce becomes more conspicuous. This tendency with respect to reset applies similarly to overdrive as well.

The following has been determined from the results of experimentation described above:

First, a very fast response is obtained by suppressing the two delays, especially bounce, which is the second delay.

Second, overall response time lengthens at low temperatures and delay time also becomes extremely long at low temperatures. Preventing delay at low temperatures, therefore, is vital in terms of realizing high-speed response.

Third, the voltage necessary for reset, etc., is greater at low temperatures.

In view of these findings from experimentation, the following are important in order to achieve a high-speed response over a full range of temperatures:

there should be no bounce at low temperatures; and there should be no reset insufficiency and no overdrive response speed insufficiency at low temperatures.

In particular, at a lower-limit temperature at which the device is used, the occurrence of bounce at high temperatures is better suppressed with use of a smaller electric field within a range in which satisfactory reset or overdrive is obtained.

More specifically, a reset-drive liquid crystal display device according to the present invention is such that the intensity of the electric field used in reset is an intensity at which sufficient reset is obtained at a lower-limit temperature at which the device is used, and at which bounce will not occur in the response characteristic in the vicinity of room temperature.

Further, the intensity of the electric field used in reset is a minimum intensity among intensities at which sufficient reset is obtained at the lower-limit temperature at which the device is used.

Further, an overdrive liquid crystal display device according to the present invention is such that the intensity of an electric field that is greater than an electric field based upon a normal image signal is an intensity at which a sufficient speed of response is obtained at a lower-limit temperature at which the device is used, and at which bounce will not occur in the response characteristic in the vicinity of room temperature. Further, the intensity of the electric field that is greater than that of the electric field based upon the normal image signal is a minimum intensity among intensities at which a sufficient speed of response is obtained at the lower-limit temperature at which the device is used.

With a liquid crystal display device according to the present invention constructed as set forth above, a sufficient speed of response is obtained over a full range of temperatures. Although bounce, etc., occurs at high temperatures, time delay due to bounce at high temperature is short, as indicated in FIG. 1, and no problems arise in ordinary use of the device.

Several methods are available in order to achieve the above-mentioned electric field intensity in the liquid crystal display device of the present invention.

One conceivable method is to measure the response of transmittance and adjust voltage. In our experiments, we achieved the above-mentioned electric field intensity under the transmittance conditions described below. Specifically, in the liquid crystal display of the present invention, the electric field used in reset is an one of intensity greater than that of an electric field for which a 95% response between a white image and a black image is obtained, and less than that of an electric field for which a 99.9% response between a white image and a black image is obtained, in the interval in which reset is performed.

Preferably, the intensity of the electric field used in reset is larger than that of an electric field at which a 99% response between a white image and a black image is obtained, and less than that of an electric field at which a 99.9% response between a white image and a black image is obtained. Further, in the overdrive liquid crystal display of the present invention, maximum intensity of the electric field that is greater than intensity of the electric field based upon the normal image signal is an electric field intensity at which a 95% response between a white image and a black image is obtained, and less than an electric field intensity at which a 99.9% response between a white image and a black image is obtained, in an interval in which the intensity of the electric field greater than that of the electric field based upon the normal image signal is applied. Preferably, the maximum intensity of the electric field is greater than intensity of an electric field at which a 99% response between a white image and a black image is obtained, and less than intensity of an electric field at which a 99.9% response between a white image and a black image is obtained.

Here the ratio of response between the white and black images applies to both a normally white image and a normally black image. That is, with a normally white image, a 95% response, for example, is one that reaches a transmittance of 5% with respect to a difference in transmittances between a white image and a black image. With a normally black image, on the other hand, a 95% response is one that reaches a transmittance of 95% with respect to a difference in transmittances between a white image and a black image.

Why it is possible to suppress delay by setting such electric field intensity has been clarified by further analysis of the cause of delay. At the same time, a new finding has been made with regard to the method of setting the electric field.

It is known that a delay in the response of a liquid crystal brought about by excessive reset or the like is caused by the flow of the liquid crystal. Delay of decay response of a TN liquid crystal ascribable to flow is well known as being the effect of backflow. When the response of nematic liquid crystal is considered, it is necessary to take the effect of this flow into account.

In Tarumi et al., "Molecular Crystals and Liquid Crystals", vol. 263, pp. 459 to 467 (Mol. Cryst. Liq. Cryst. 1995, Vol. 263, pp. 459-467) (Non-Patent Document 3), the effects of flow of twisted nematic liquid crystal are discussed. According to the descriptions rendered on pages 463 to 466 in Non-Patent Document 3, rotational viscosity usually represented by a constant value becomes two effective viscosities dependent upon the angle owing to the effects of flow. Dynamic equations in which these two effective viscosities are satisfied are indicated by Equation (4) and (5) below.

$$\gamma_\theta^{eff}(\theta, \phi)\cdot\partial_t\,\theta = -\frac{\delta F}{\delta\theta} \tag{4}$$

$$\gamma_\theta^{eff}(\theta, \phi)\cdot\partial_t\,\phi = -\frac{\delta F}{\delta\phi} \tag{5}$$

In Equations (4) and (5) above, F represents the Frank free energy, $\gamma_\theta^{eff}$ the non-linear effective viscosity with respect to the tilt angle (rise angle) of the liquid crystal director, and $\gamma_\Phi^{eff}$ the non-linear effective viscosity with respect to the twist angle of the liquid crystal director.

Figure 4:
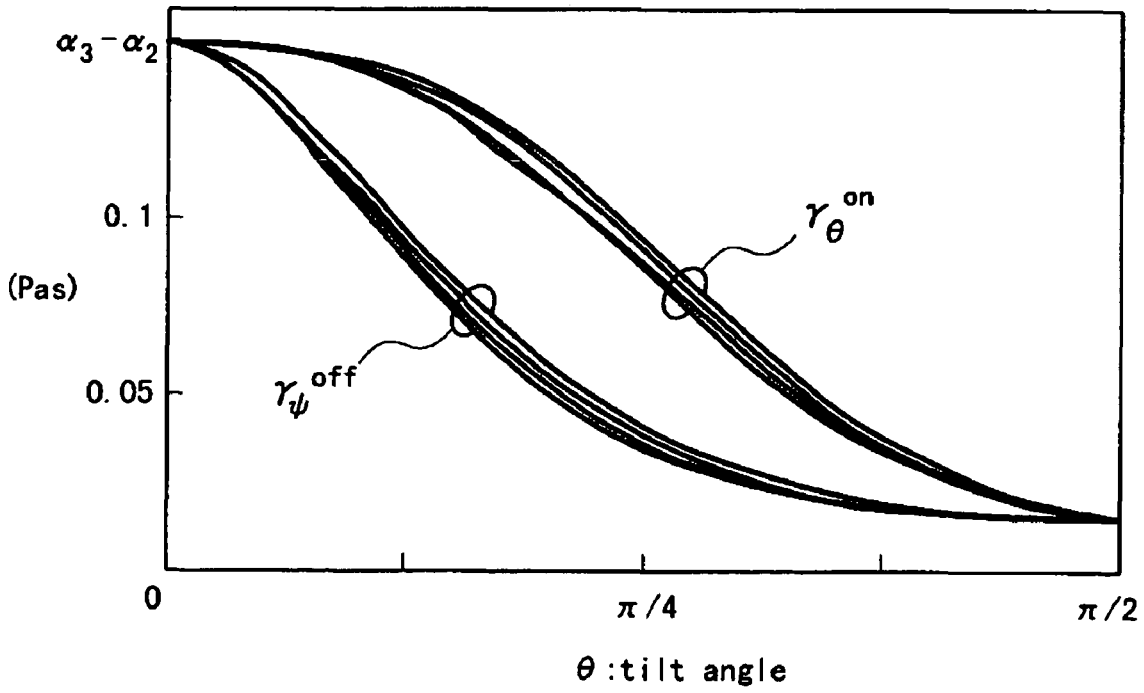
FIG. 4 is a graph illustrating dependence of two effective viscosities on tilt angle and twist angle.

These two viscosities vary in dependence upon the tilt angle and twist angle. The manner in which the viscosities vary is illustrated in FIG. 4, in which tilt angle (rise angle) is plotted along the horizontal axis and $\alpha_3$-$\alpha_2$ on the vertical axis corresponds to the rotational viscosity. Further, the dependence of $\gamma_\theta^{eff}$ and $\gamma_\Phi^{eff}$ on the twist angle is small. Even if the twist angle is changed, variance in each of the curve groups is small, with the curves bulging only slightly. In other words, the effective viscosity depends greatly upon the tilt angle.

It is known that the cause of a delay in liquid crystal response due to flow is that owing to a decline in effective viscosity, the orientation of the liquid crystal readily follows up the change ascribable to the flow. When this fact and the fact that effective viscosity depends greatly upon the tilt angle are taken into consideration, it will be understood that maintaining a tilt angle at which there will not be much of a decline in effective viscosity is effective in order to prevent the occurrence of delay due to flow.

In view of the existence of the first and second delays in FIG. 1 and the existence of the two effective viscosities, it has been determined that the first delay occurs owing to a decline in the effective viscosity $\gamma_\Phi^{eff}$ in the twist direction and that the second delay occurs owing to a decline in the effective viscosity $\gamma_\theta^{eff}$ in the tilt direction.

The decline in the effective viscosity $\gamma_\theta^{eff}$ in the tilt direction occurs at a larger tilt angle and corresponds to a higher electric field intensity.

As a result, the second delay, namely bounce, occurs when the electric field intensity is high.

Conversely, in order to not allow bounce to occur, it is important to so arrange it that the effective viscosity $\gamma_\theta^{eff}$ in the tilt direction will not be allowed to diminish excessively.

The inventor has measured average tilt angle of orientation of the liquid crystal and have found that the first delay occurs when the tilt angle exceeds approximately 63 degrees and that the second delay occurs when the tilt angle exceeds approximately 85 degrees.

In other words, it is vital that the tilt angle not exceed 85 degrees in order to avoid the occurrence of the second delay.

On the hand, it has been determined that the tilt angle which prevails when the speed-up effect of sufficient reset or overdrive is obtained is 75 degrees.

The angle of 75 degrees corresponds to a 95% response in terms of transmittance. Furthermore, it has been determined that the tilt angle which prevails when the effect of sufficient reset or overdrive is obtained at low temperature is 81 degrees. This corresponds to a 99% response in terms of transmittance.

In view of the facts set forth above, an excellent speed of response can be obtained and an excellent display realized over a full range of temperatures by adopting a tilt angle in accordance with the present invention.

Preferred embodiments of the present invention will now be described in detail with reference to the drawings.

A first preferred embodiment of the present invention relates to a liquid crystal display device having nematic liquid crystal interposed between a pair of supporting substrates for operating the liquid crystal by an electric field applied across at least two electrodes, wherein reset for temporarily returning the orientation of the liquid crystal to a prescribed state is performed, the intensity of the electric field used in reset is made as an intensity at which sufficient reset is obtained at a lower-limit temperature at which the device is used, and at which bounce will not occur in the response characteristic in the vicinity of room temperature.

In the embodiment of the present invention, a delay due to bounce does not occur and therefore a very fast response is obtained. Further, sufficient reset is obtained even at low temperature and therefore insufficient reset does not arise.

In a second embodiment of the present invention, the intensity of the electric field used in reset in the first embodiment is a minimum intensity among intensities at which sufficient reset is obtained at the lower-limit temperature at which the device is used.

A third preferred embodiment of the present invention relates to a liquid crystal display device having nematic liquid crystal interposed between a pair of supporting substrates for operating the liquid crystal by an electric field applied across at least two electrodes, wherein in a case where drive for raising speed of response is performed by applying an electric field of field intensity greater than that of an electric field based upon a normal image signal across the electrodes, the intensity of the electric field that is greater than the electric field based upon the normal image signal is a intensity at which a sufficient speed of response is obtained at a lower-limit temperature at which the device is used, and at which bounce will not occur in the response characteristic in the vicinity of room temperature.

In the third embodiment of the present invention, bounce does not occur and therefore a very fast response is obtained. Further, a sufficient effect is obtained even at low temperature and therefore an excellent display can be achieved.

Furthermore, a more effective image signal can be selected by a decision based upon a comparison between data retained by each pixel prior to writing of the image signal and display data to be displayed anew. For example, a circuit of the kind described in Patent Document 2 can be used.

Figure 5:
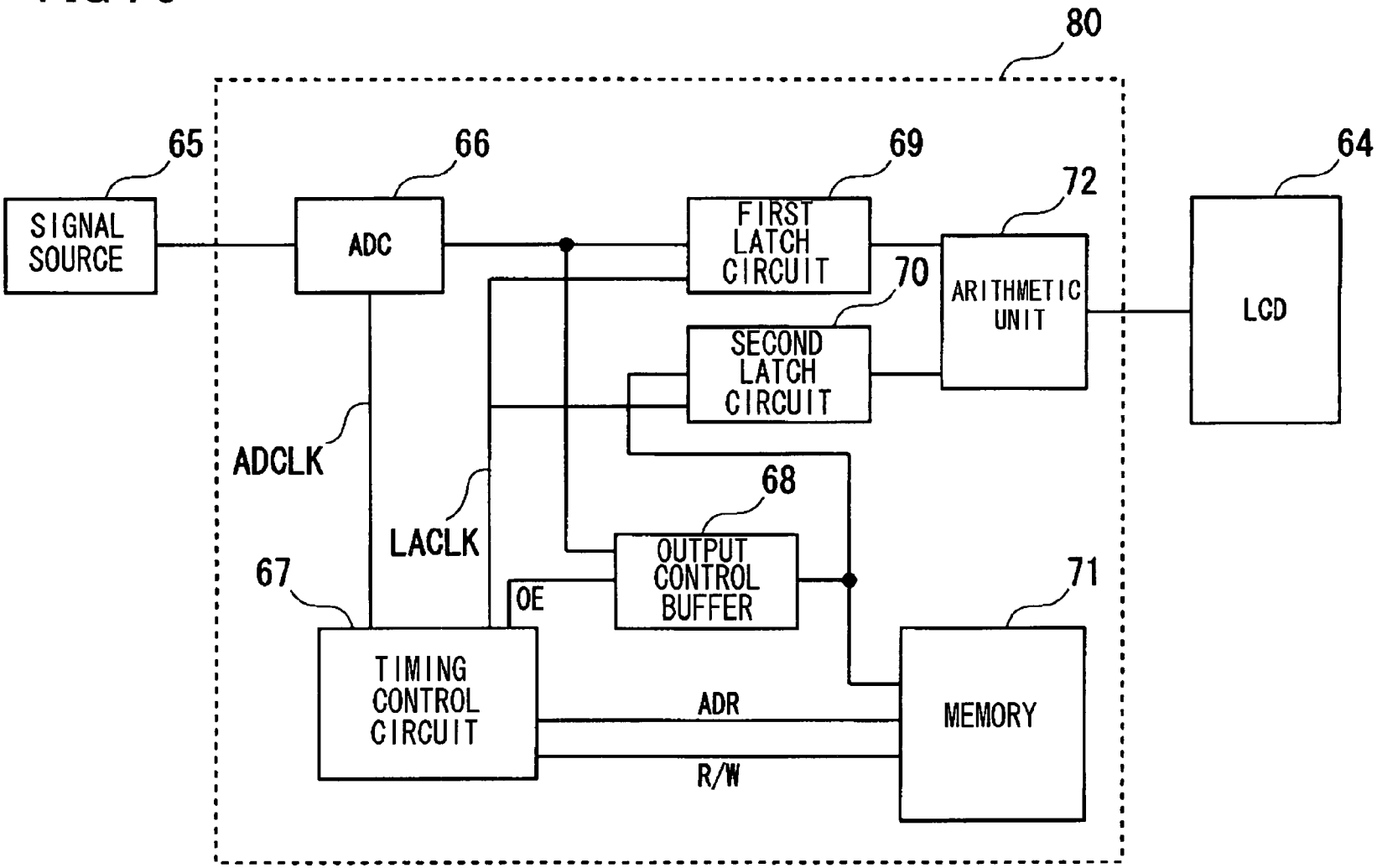
FIG. 5 is a block diagram illustrating an example of a drive unit for driving a display device according to a mode of practicing the present invention.

FIG. 5 illustrates an example of the drive apparatus based upon Patent Document 2. This display device displays an image of each display frame by applies a write-signal voltage, which corresponds to the display data, to each pixel that is successively designated. A drive apparatus 80 for driving a liquid crystal display (LCD) 64 is connected between a signal source 65 and the LCD 64. The drive apparatus 80 includes an analog/digital converter circuit (abbreviated to "ADC circuit" below) 66; a first latch circuit 69 connected to the ADC circuit 66; an output control buffer 68 connected to the ADC circuit 66; a memory 71 connected to the output control buffer 68; a second latch circuit 70 connected to the memory 71 via a node interconnecting the output control buffer 68 and memory 71; an arithmetic unit 72 connected to the first latch circuit 69 and second latch circuit 70; and a timing control circuit 67. The ADC circuit 66 converts an analog signal from the signal source 65 into a digital signal. The output control buffer 68, which has an output control function, receives a control signal OE from the timing control circuit 67 and places its output terminal at a high impedance (referred to as "Hi-Z" below). In an output-enabled state in which data entered when the control signal OE is at the high level is output, Hi-Z is the result when the signal is at the low level. The memory 71, which has a capacity greater than one frame, is controlled by an address signal ADR and control signal R/W. The memory 71 performs a read operation when the signal R/W is at the high level and a write operation when this signal is at the low level. The first and second latch circuits 69, 70 are circuits for loading and latching input data while receiving a clock LACLK. Here data is loaded at the rising edge of the clock and held until the next rising edge.

The first latch circuit 69 latches a image signal voltage VS (m,n), and the second latch circuit 70 latches a image signal voltage VS (m,n−1). Using an Equation (18) below, the arithmetic unit 72 sets a write signal voltage Vex (m,n) of an mth pixel of frame n based upon the linear sum of image signal voltage VS (m,n−1) of the mth pixel of the preceding frame n−1 and image signal voltage VS (m,n) of the mth pixel of frame n displayed next.

The timing control circuit 67 controls the timing of each signal. The memory 71 and arithmetic unit 72 construct display control means. The write signal voltage Vex (m,n) of an mth pixel of frame n is found from the following linear sum of image signal voltage VS (m,n−1) of the mth pixel in frame n−1 displayed previously and image signal voltage VS (m,n) of the mth pixel in frame n displayed next:

$$Vex(m,n)=AVS(m,n)+BVS(m,n-1) \tag{18}$$

where A and B are constants.

In a fourth embodiment of the present invention, the intensity of the electric field that is greater than that of the electric field based upon the normal image signal in the third embodiment is a minimum intensity among intensities at which a sufficient speed of response is obtained at the lower-limit temperature at which the device is used.

In a fifth embodiment of the present invention, the electric field used in reset in the first or second embodiment is an intensity of the electric field greater than that of an electric field at which a 95% response between a white image and a black image is obtained, and less than that of an electric field at which a 99.9% response between a white image and a black image is obtained, in an interval in which reset is performed. More preferably, in an interval in which reset is performed, the intensity of the electric field used in reset is greater than that of an electric field at which a 99% response between a white image and a black image is obtained, and less than that of an electric field at which a 99.9% response between a white image and a black image is obtained.

In a sixth embodiment of the present invention, the maximum intensity of the electric field that is greater than that of the electric field based upon the normal image signal in the third or fourth embodiment is an intensity of the electric field greater than that of an electric field at which a 95% response between a white imaeg and a black image is obtained, and smaller than that of an electric field at which a 99.9% response between a white image and a black image is obtained, in an interval in which the intensity of the electric field greater than that of the electric field based upon the normal image signal is applied. More preferably, the maximum intensity of the electric field greater than that of the electric field that is based upon the normal image signal is greater than intensity of an electric field at which a 99% response between a white image and a black image is obtained, and less than intensity of an electric field at which a 99.9% response between a white image and a black image is obtained, in the interval in which the intensity of the electric field greater than that of the electric field based upon the normal image signal is applied.

In a seventh embodiment of the present invention, the electric field used in reset in the first or second embodiment is an intensity of the electric field greater than that of an electric field at which average tilt angle of the liquid crystal exceeds 75 degrees, and at which average tilt angle does not exceed 85 degrees, in an interval in which reset is performed. Preferably, the electric field used in reset is an intensity of the electric field greater than that of an electric field at which average tilt angle of the liquid crystal exceeds 81 degrees, and at which average tilt angle does not exceed 85 degrees.

In an eighth embodiment of the present invention, maximum intensity of the electric field greater than that of the electric field based upon the normal image signal in the third or fourth embodiment is an intensity of the electric field greater than that of an electric field at which average tilt angle of the liquid crystal exceeds 75 degrees, and at which average tilt angle does not exceed 85 degrees, in an interval in which the intensity of the electric field greater than that of the electric field based upon the normal image signal is applied. More preferably, the maximum intensity of the electric field greater than that of the electric field based upon the normal image signal is greater than intensity of an electric field at which average tilt angle of the liquid crystal exceeds 81 degrees, and at which average tilt angle does not exceed 85 degrees, in an interval in which the intensity of the electric field greater than that of the electric field based upon the normal image signal is applied.

A ninth embodiment of the present invention relates to a method of driving a liquid crystal display device having nematic liquid crystal interposed between a pair of supporting substrates for operating the liquid crystal by an electric field applied across at least two electrodes, and performing reset for temporarily returning the orientation of the liquid crystal to a predetermined state, comprising the steps of making the intensity of the electric field used in reset as an intensity at which sufficient reset is obtained at a lower-limit temperature at which the device is used, and at which bounce will not occur in the response characteristic in the vicinity of room temperature. More preferably, the intensity of the electric field used in reset is made as a minimum intensity among intensities at which sufficient reset is obtained at the lower-limit temperature at which the device is used.

A tenth embodiment of the present invention relates to a method of driving a liquid crystal display device having nematic liquid crystal interposed between a pair of supporting substrates for operating the liquid crystal by an electric field applied across at least two electrodes, and raising speed of response by applying an electric field, which has an intensity higher than that of an electric field based upon a normal image signal, across the electrodes, comprising making the intensity of the electric field that is greater than the electric field based upon the normal image signal as an intensity at which a sufficient speed of response is obtained at a lower-limit temperature at which the device is used, and at which bounce will not occur in the response characteristic in the vicinity of room temperature. More preferably, the intensity of the electric field that is greater than that of the electric field based upon the normal image signal is made as a minimum intensity among intensities at which a sufficient speed of response is obtained at the lower-limit temperature at which the device is used.

In an 11th embodiment of the present invention, the electric field used in reset in the ninth embodiment is made an intensity of the electric field greater than that of an electric field at which a 95% response between a white image and a black image is obtained, and smaller than that of an electric field at which a 99.9% response between a white image and a black image is obtained, in an interval in which reset is performed. More preferably, the intensity of the electric field used in reset is made greater than that of an electric field at which a 99% response between a white image and a black image is obtained, and smaller than that of an electric field at which a 99.9% response between a white image and a black image is obtained.

In a 12th embodiment of the present invention, the maximum intensity of the electric field that is greater than that of the electric field based upon the normal image signal in the tenth embodiment is made an intensity of the electric field greater than that of an electric field at which a 95% response between a white image and a black image is obtained, and smaller than that of an electric field at which a 99.9% response between a white image and a black image is obtained, in an interval in which the intensity of the electric field greater than that of the electric field based upon the normal image signal is applied. More preferably, the maximum intensity of the electric field greater than that of the electric field that is based upon the normal image signal is made greater than intensity of an electric field at which a 99% response between a white image and a black image is obtained, and smaller than intensity of an electric field at which a 99.9% response between a white image and a black image is obtained, in the interval in which the intensity of the electric field greater than that of the electric field based upon the normal image signal is applied.

In a 13th embodiment of the present invention, the electric field used in reset in the ninth embodiment is made an intensity of the electric field greater than that of an electric field at which average tilt angle of the liquid crystal exceeds 75 degrees, and at which average tilt angle does not exceed 85 degrees, in an interval in which reset is performed. More preferably, the electric field used in reset is made as an intensity of the electric field greater than that of an electric field at which average tilt angle of the liquid crystal exceeds 81 degrees, and at which average tilt angle does not exceed 85 degrees.

In a 14th embodiment of the present invention, maximum intensity of the electric field which has an intensity greater than that of the electric field based upon the normal image signal is made greater than an intensity of an electric field at which average tilt angle of the liquid crystal exceeds 75 degrees, and at which average tilt angle does not exceed 85 degrees, in an interval in which the the electric field which has an intensity greater than that of the electric field based upon the normal image signal is applied. More preferably, the maximum intensity of the electric field which has an intensity greater than that of the electric field based upon the normal image signal is made greater than an intensity of an electric field at which average tilt angle of the liquid crystal exceeds 81 degrees, and at which average tilt angle does not exceed 85 degrees, in an interval in which the intensity of the electric field greater than that of the electric field based upon the normal image signal is applied.

A 15th embodiment of the present invention relates to a near-eye apparatus that employs a liquid crystal display device according to any one of the first to eighth embodiments. Examples of a near-eye apparatus include a viewfinder of a camera or video camera, a head-mounted display, a heads-up display or other devices used close to the eye (e.g., within 5 cm or less).

Since the 15th embodiment of the invention is used in near-eye applications, high image quality such as good color reproduction, image sharpness and crispness of moving pictures is required. The present invention is applicable in such cases.

A 16th embodiment of the present invention relates to projection apparatus for projecting an original image of a liquid crystal display device using a projection optical system, the projection apparatus using a liquid crystal display device according to any one of the first to eighth embodiments. Examples of a projection apparatus include projectors such as a front projection or rear projector, and an enlarging observation device, etc.

Since the 16th embodiment is used in projection applications, images are greatly enlarged. This makes a high image quality a strict requirement and therefore the present invention is applied.

A 17th embodiment of the present invention relates to a mobile terminal that employs a liquid crystal display device according to any one of the first to eighth embodiments. Mobile terminals include a mobile telephone, an electronic notebook, a PDA (Personal Digital Assistant) and a wearable personal computer, etc.

The 17th embodiment is an application that is normally carried about and often employs a battery or dry cell. Low power consumption is required, therefore, and hence the method of the present invention is applied. Further, since a mobile terminal is often used both indoors and outdoors, the method of the present invention, which exhibits a high efficiency of utilization of light, is desired in order to obtain sufficient brightness. Furthermore, since a mobile terminal is used in a wide range of temperatures depending upon the environments in which terminal is carried out, the present invention, which has a broad temperature range, is ideal.

An 18th embodiment of the present invention relates to a liquid crystal monitor that employs a liquid crystal display device according to any one of the first to eighth embodiments. Monitors include those for personal computers, audio-visual devices (televisions, etc.), a monitor for medical care, a monitor in a design application, and a monitor in a picture apprecitation application.

The 18th embodiment of the invention is a monitor used on a desktop or the like and often is observed carefully. A high image quality is desired, therefore, and hence the present invention is applied.

A 19th embodiment of the present invention relates to a liquid crystal display unit for a vehicle and employs a liquid crystal display device according to any one of the first to eighth embodiments. The vehicle includes a car, an airplane, a ship and a train, etc.

The 19th embodiment of the invention is an apparatus associated with a vehicle and is not an apparatus carried about by a person as in the 17th embodiment. Since a vehicle experiences a wide variety of changes in environment, the present invention, which exhibits little dependence upon environmental changes such as changes in light intensity and temperature, is ideal. Further, since the power source is limited, low electric power consumption is desired and, hence, the present invention is ideal. Examples in which the present invention is applied will now be described.

EXAMPLE 1

Figure 7:
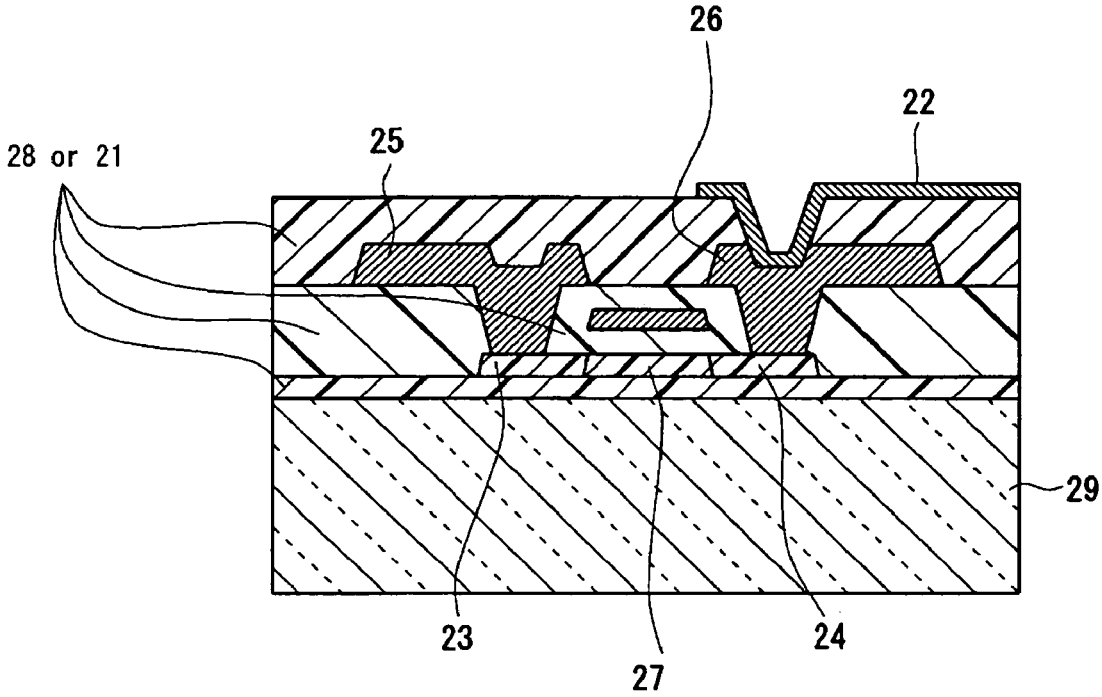
FIG. 7 is a sectional view illustrating the cross-sectional structure of a planar-type polycrystalline silicon TFT switch used in the first embodiment.

Before the details of Example 1 are described, an example of a TFT array used in the present invention will be described. First, reference will be had to FIG. 7 to describe the unit structure of a polycrystalline silicon TFT array in which amorphous silicon is modified to polycrystalline silicon. FIG. 7 is a diagram schematically illustrating the cross section of a polycrystalline silicon TFT array.

The polycrystalline silicon TFT in FIG. 7 was fabricated as follows: First, a silicon oxide film 28 was formed on a glass substrate 29, after which amorphous silicon was allowed to grow.

Next, the amorphous silicon was modified to polycrystalline silicon 27 by annealing using an excimer laser, and the silicon oxide film 28 was allowed to grow further to a thickness of 10 nm. After patterning was applied, a photoresist was patterned into a shape slightly larger than that of a gate [in order to subsequently form LDD (Lightly Doped Drain) regions 23, 24] and doping with phosphorous ion was performed to thereby form a source region (electrode) 26 and a drain region (electrode) 25.

After the silicon oxide film 28 serving as a gate oxide film was grown, amorphous silicon and tungsten silicide (WSi) to serve as a gate electrode was grown. This was followed by patterning a photoresist and patterning the amorphous silicon and tungsten silicide (WSi) into the shape of a gate electrode using the photoresist as a mask.

Furthermore, using the patterned photoresist as a mask, only the necessary regions were doped with phosphorus ions to thereby form the LDD areas 23, 24.

After the silicon oxide film 28 and a silicon nitride film 21 were successively grown, holes for contact were formed, aluminum and titanium were formed by sputtering and patterning was applied to form the source electrode 26 and drain electrode 25.

The silicon nitride film 21 was then formed over the entire surface, holes for contact were provided, an ITO film was formed over the entire surface and patterning was applied to form a transparent pixel electrode 22.

Thus, a planar-type TFT pixel switch of the kind shown in FIG. 7 was fabricated and a TFT array was formed to provide a TFT-switch pixel array and a scanning circuit on the glass substrate.

In FIG. 7, a TFT in which amorphous silicon was modified to polycrystalline silicon was formed. However, the TFT may just as well be formed by improving the particle diameter of polycrystalline silicon by laser irradiation after the polycrystalline silicon is grown.

Further, the laser is not limited to an excimer laser and may just as well be a continuous-wave (CW) laser.

Furthermore, an amorphous silicon TFT can be formed by eliminating the step of modifying amorphous silicon to polycrystalline silicon by laser irradiation.

FIGS. 8*a* to 8*d* and FIGS. 9*a* to 9*d* are process sectional views illustrating a method of manufacturing a polycrystalline silicon TFT (planar-structure) array. The method of manufacturing the polycrystalline silicon array will be described in detail with reference to FIGS. 8*a* to 8*d* and FIGS. 9*a* to 9*b*.

First, a silicon oxide film 11 is formed on a glass substrate 10, after which amorphous silicon 12 is allowed to grow. Next, the amorphous silicon is modified to polycrystalline silicon by annealing using an excimer laser [in FIG. 8*a*].

Figure 8A:
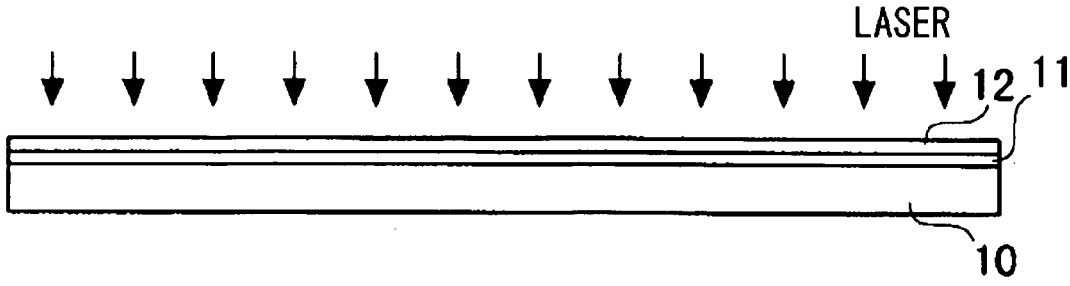
FIGS. 8*a*, 8*b*, 8*c* and 8*d* are sectional views useful in describing the principal steps of a process for fabricating a display panel substrate used in the present invention.
Figure 8B:
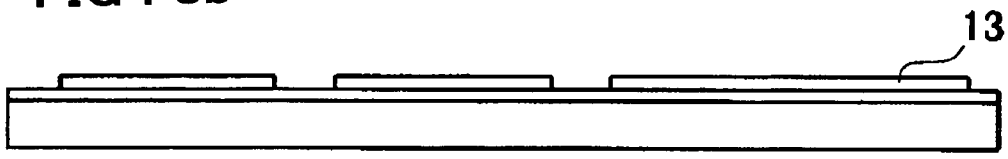
Figure 8C:
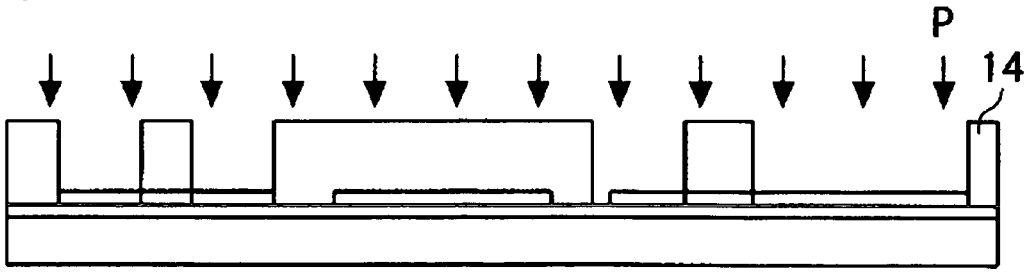

A silicon oxide film 13 of thickness 10 nm is grown and patterning is performed [in FIG. 8*b*], after which a photoresist 14 is applied and patterned (a p-channel region is masked) and doping performed with phosphorous (P) ion, thereby forming an n-channel source and drain regions [in FIG. 8*c*].

Figure 8D:
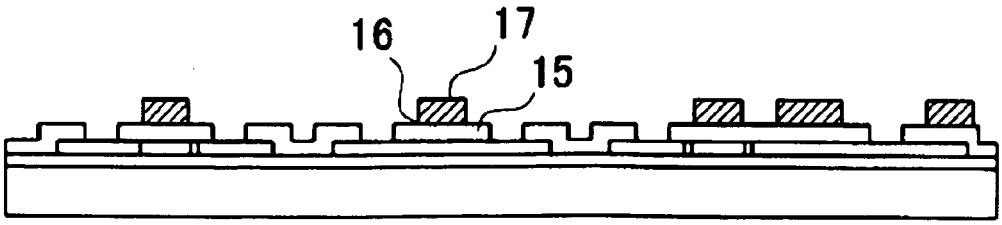

Furthermore, a silicon oxide film 15 of thickness 90 nm to serve as a gate insulating film is grown, after which microcrystalline silicon 16 and tungsten silicide (WSi) 17 for constructing a gate electrode are grown and patterned into a shape of a gate [in FIG. 8*d*].

Figure 9A:
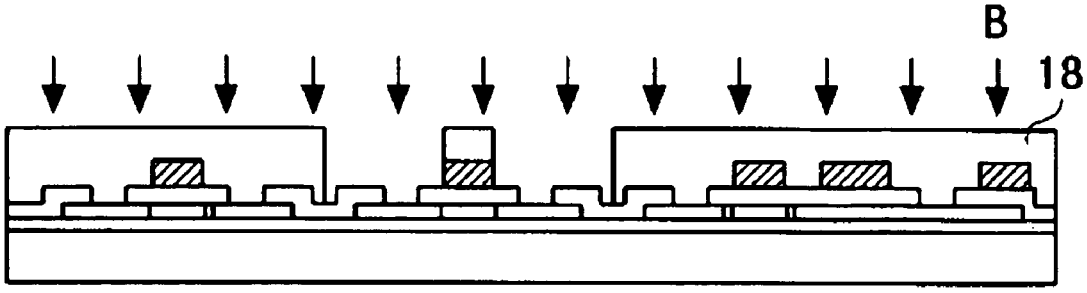
FIGS. 9*a*, 9*b*, 9*c* and 9*d* are sectional views useful in describing the principal steps of a process for fabricating a display panel substrate used in the present invention.

A photoresist 18 is applied and patterned (to mask an n-channel region), doping is performed using boron (B) and n-channel source and drain regions are formed [in FIG. 9*a*].

Figure 9B:
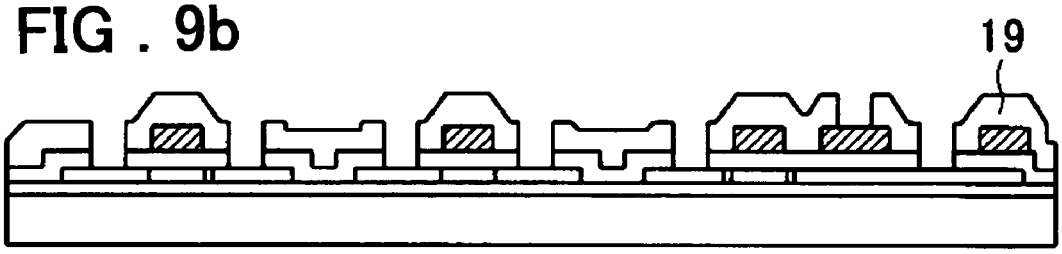
Figure 9C:
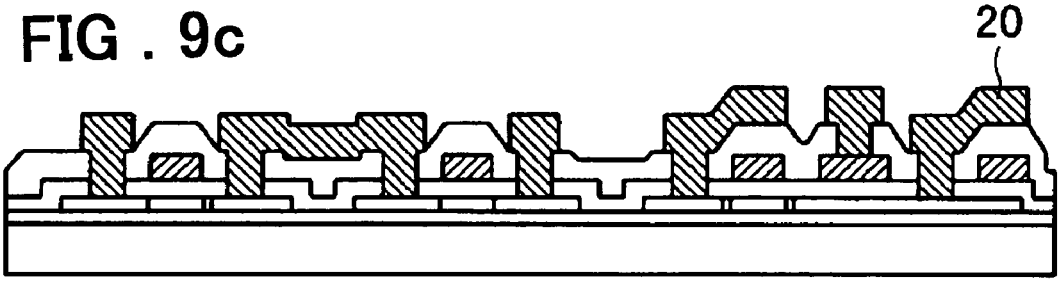
Figure 9D:
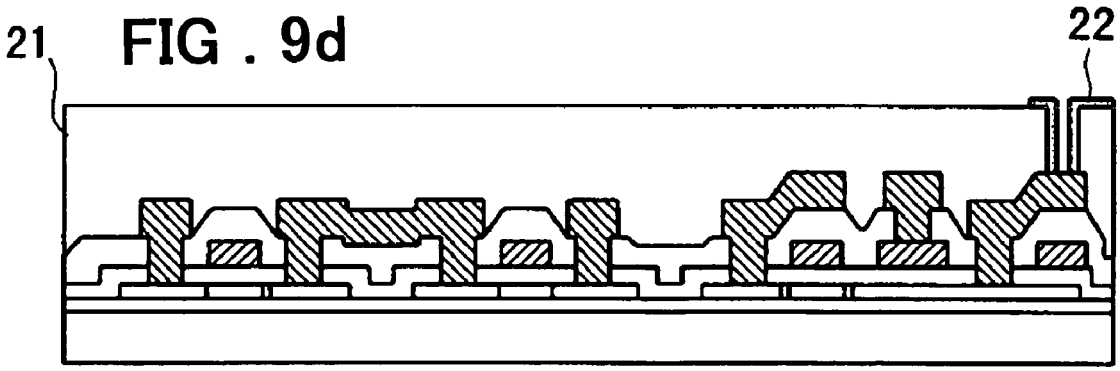
Figure 10:
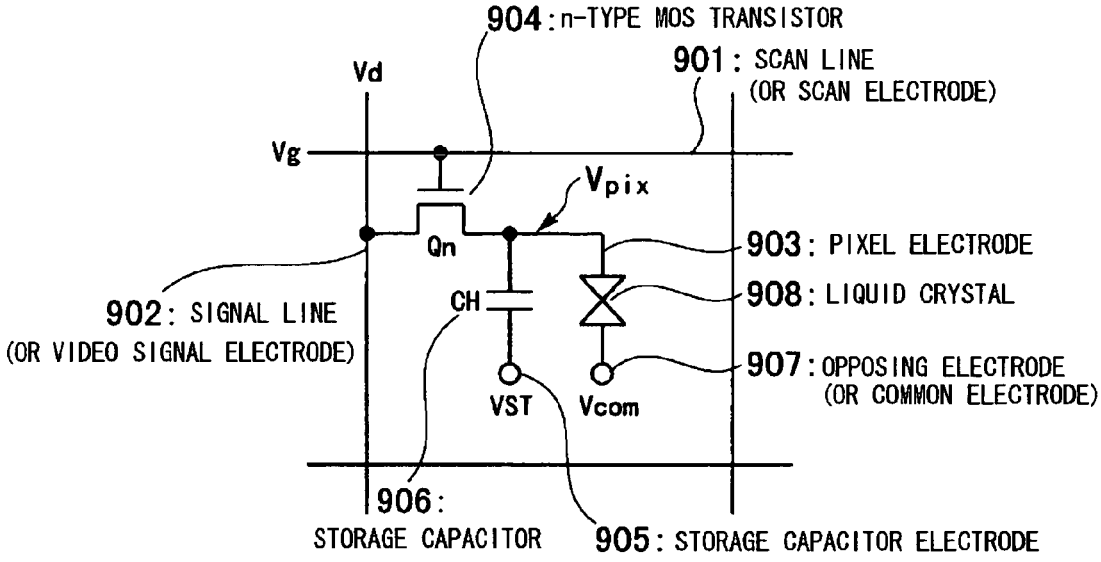
FIG . 10 PRIOR ART
FIG. 10 a diagram illustrating an example of a pixel circuit composing a liquid crystal display device according to the prior art.
Figure 11:
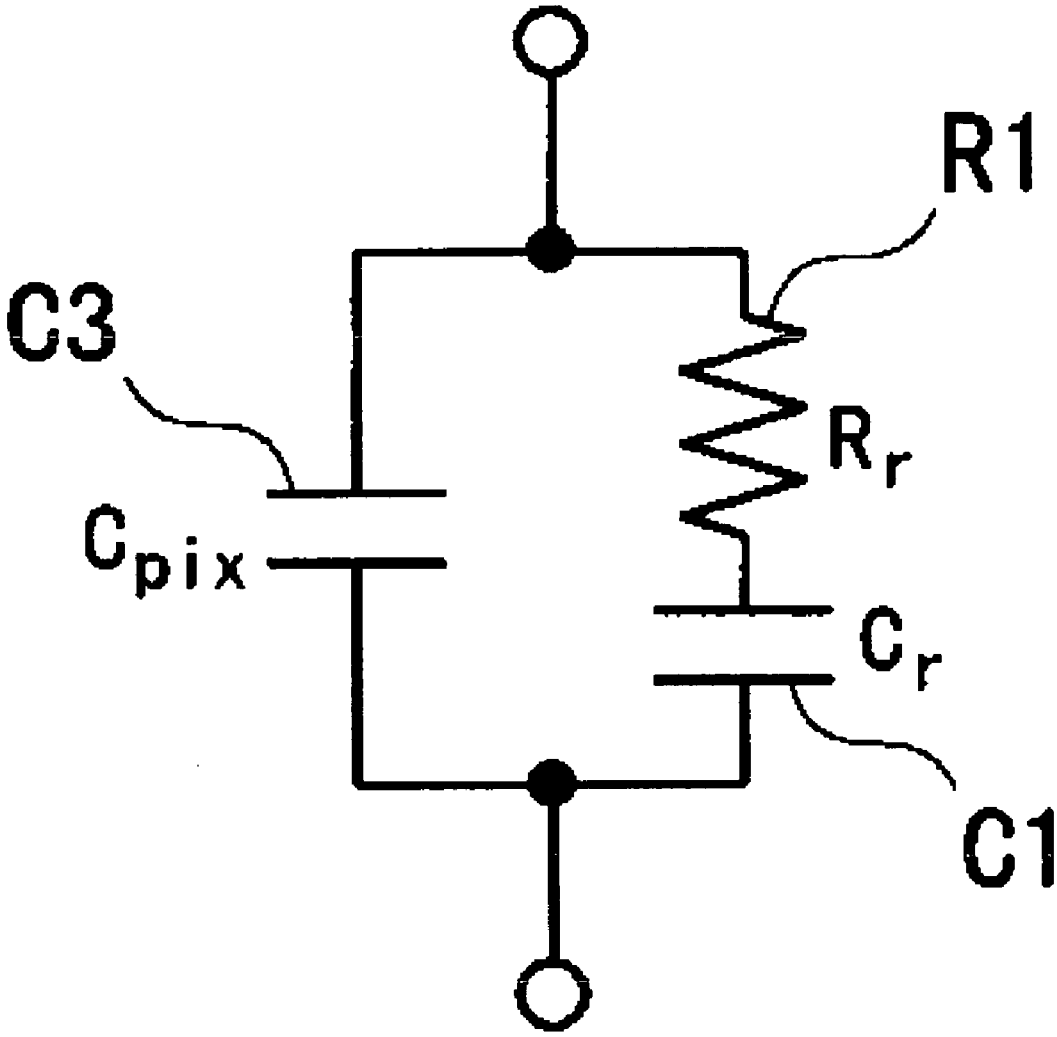
FIG. 11 is a diagram illustrating an equivalent circuit of a TN liquid crystal.
Figure 12:
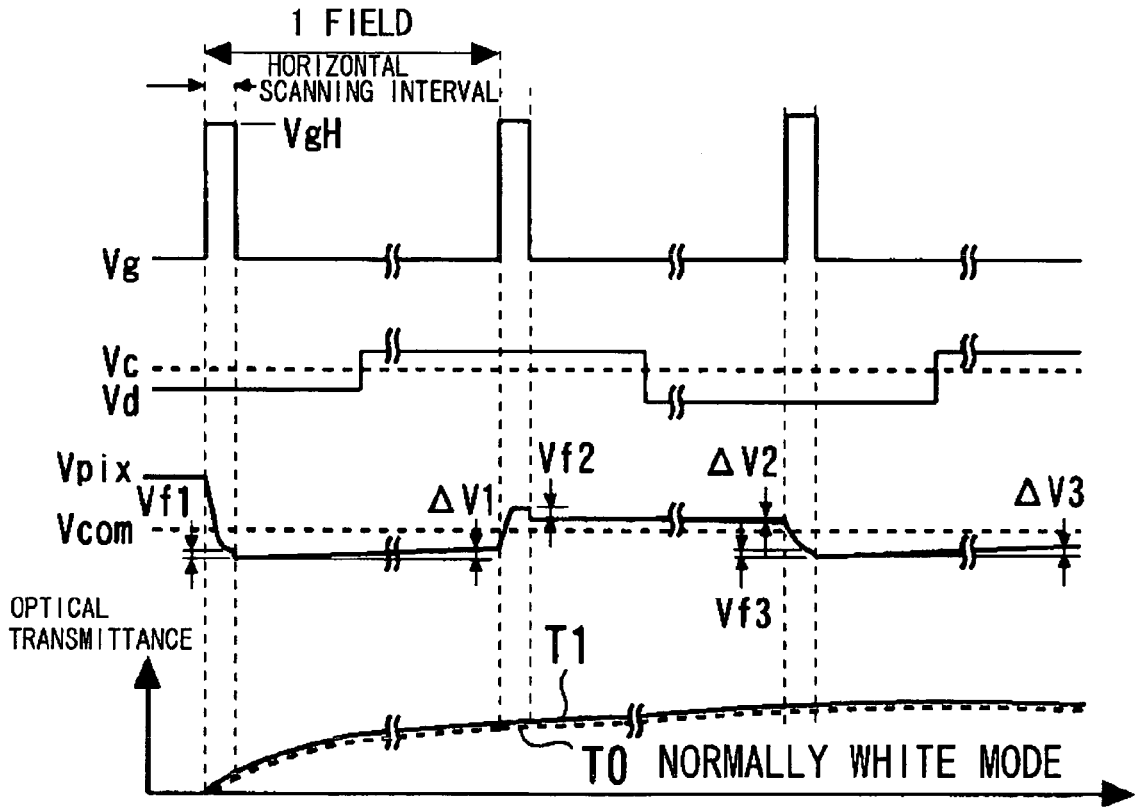
FIG . 12 PRIOR ART
FIG. 12 is a timing chart for a case where a TN liquid crystal is driven in a liquid crystal display device according to the prior art.
Figure 13:
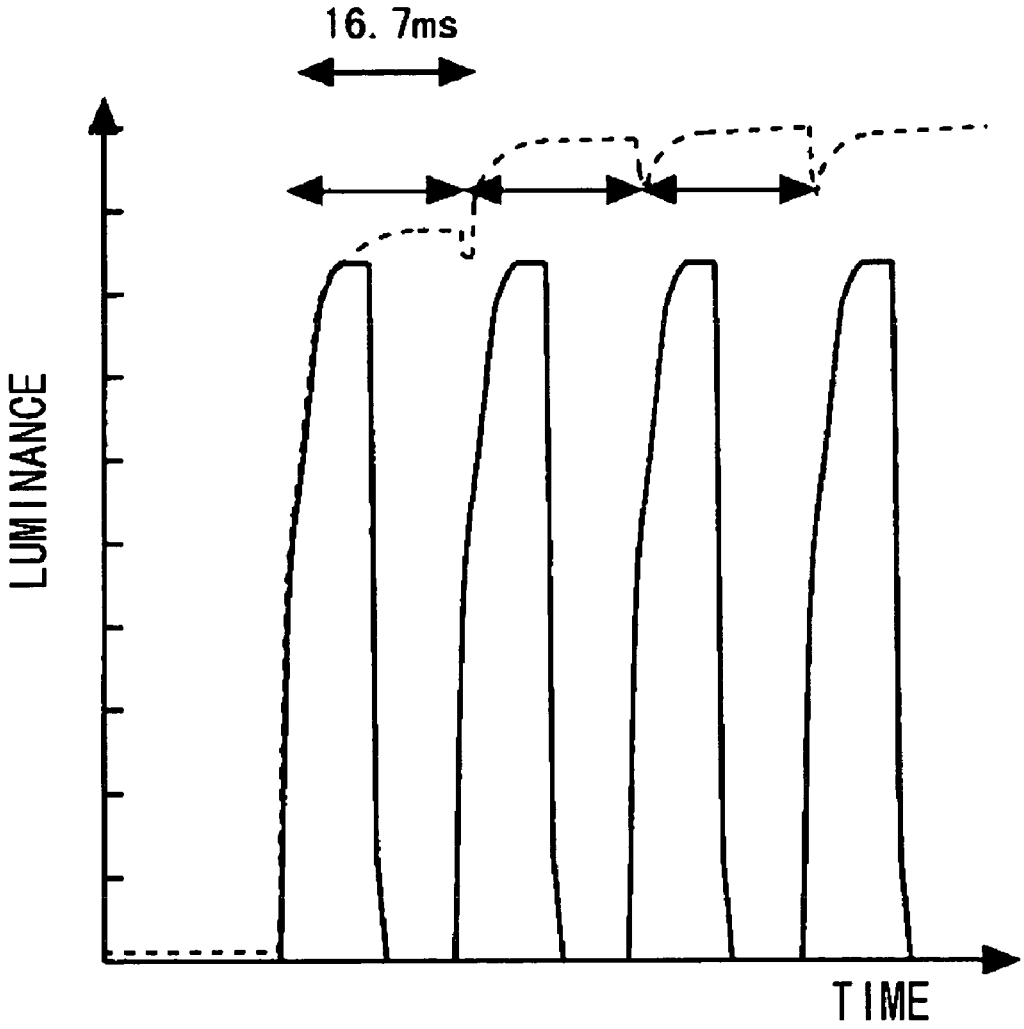
FIG . 13 PRIOR ART
FIG. 13, which illustrates the effects of reset drive according to the prior art, is a graph illustrating a change in light intensity in case of ordinary drive, which is indicated by the dashed lines, and in case of reset drive, which is indicated by the solid lines.
Figure 14:
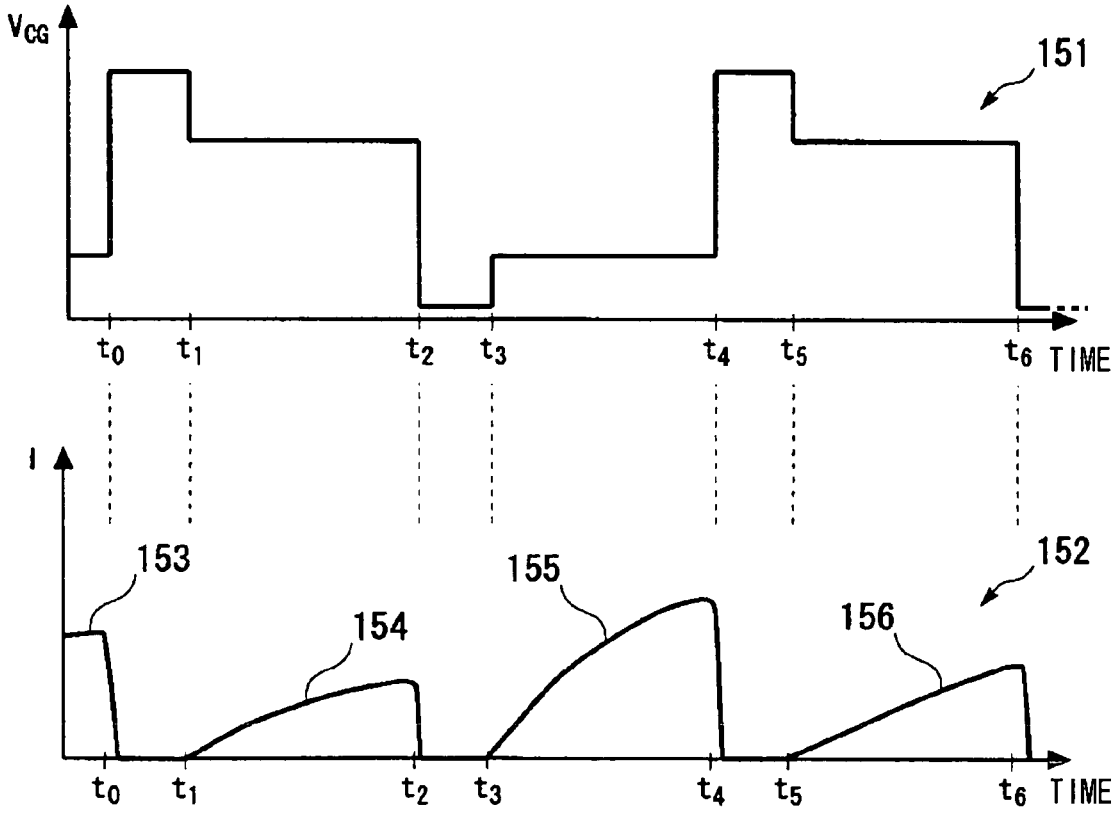
FIG .14 PRIOR ART
FIG. 14 illustrates diagrams that are useful in describing drive that modulates common voltage in the prior art, in which the upper diagram shows a voltage waveform applied to a common electrode and the lower diagram the intensity of light.

After the silicon oxide film and a silicon nitride film 19 are successively grown, holes for contact are provided [in FIG. 9*b*], and aluminum and titanium 20 are formed by sputtering and patterning is performed [in FIG. 9*c*].

CMOS source and drain electrodes of a peripheral circuit, data-line wiring connected to the drain of the pixel switch TFT and a contact to the pixel electrode are formed. Next, an insulating silicon nitride film 21 is formed, holes for contact are provided, ITO (indium tin oxide) 22 serving as a transparent electrode is formed for the pixel electrode and patterning is performed [in FIG. 9*d*].

Thus, a planar-type TFT pixel switch is fabricated and a TFT array is formed. Although tungsten silicide is used as the gate electrode, another electrode material such as chromium can also be used.

A liquid crystal panel is formed by interposing liquid crystal between this fabricated TFT array substrate and an opposing substrate on which an opposing electrode has been formed.

The opposing electrode is obtained by forming an ITO film on the entire surface of a glass substrate that will serve as the opposing substrate, patterning is performed and then a patterning layer of chromium for light-shielding purposes is formed. The patterning layer of chromium for light shielding may be formed before the ITO film is formed on the entire surface.

A column patterned to 2 μm is fabricated on the side of the opposing electrode. The column is used as a spacer for maintaining the cell gap and affords resistance to impact. Since the column is for maintaining cell gap, the height of the column can be changed appropriately depending upon the design of the liquid crystal panel.

Alignment films are printed on the opposing surfaces of the TFT array substrate and opposing substrate and rubbing is performed, thereby so arranging it that alignment directions that form an angle of 90 degrees will be obtained after assembly.

This is followed by applying a sealant for ultraviolet curing to the exterior portions of pixel regions on the opposing substrate. After the TFT array substrate and the opposing substrate are faced each other and bonded, the gap between them is filled with liquid crystal to form a liquid crystal panel.

Although the patterning layer consisting of chromium as the light-shielding film is provided on the side of the opposing substrate, this layer can also be provided on the side of the TFT array substrate. The light-shielding film is not limited to chromium and may be any material that is capable of blocking light. For example, WSi (tungsten silicide), aluminum and silver alloy, etc., can be used.

In a case where the patterning layer of chromium for blocking light is formed on the TFT array substrate, three types of structure are available.

The first structure is one in which the patterning layers of chromium for blocking light is formed on a glass substrate. After this light-shielding patterning layer is formed, manufacture can be carried out in a manner similar to that of the process described above.

The second structure is one in which after the TFT array substrate is manufactured in a manner similar to that of the structure described above, the light-shielding patterning layer of chromium is provided last.

The third structure is one in which the light-shielding patterning layer of chromium is provided during the course of fabrication of the structure described above.

In a case where the light-shielding patterning layer of chromium is formed on the side of the TFT array substrate, the light-shielding patterning layer of chromium need not be formed on the opposing substrate. The opposing substrate can be obtained by forming an ITO film on the entire surface and then performing patterning.

In an example of the present invention, nematic liquid crystal was interposed between the TFT array substrate and the opposing substrate and a 90 degrees-twisted orientation between the two substrates is realized to obtain the TN mode.

Further, a scanning-electrode drive circuit, signal-electrode drive circuit, part of a synchronous circuit and part of a common-electrode potential control circuit were fabricated on a glass substrate.

Figure 6:
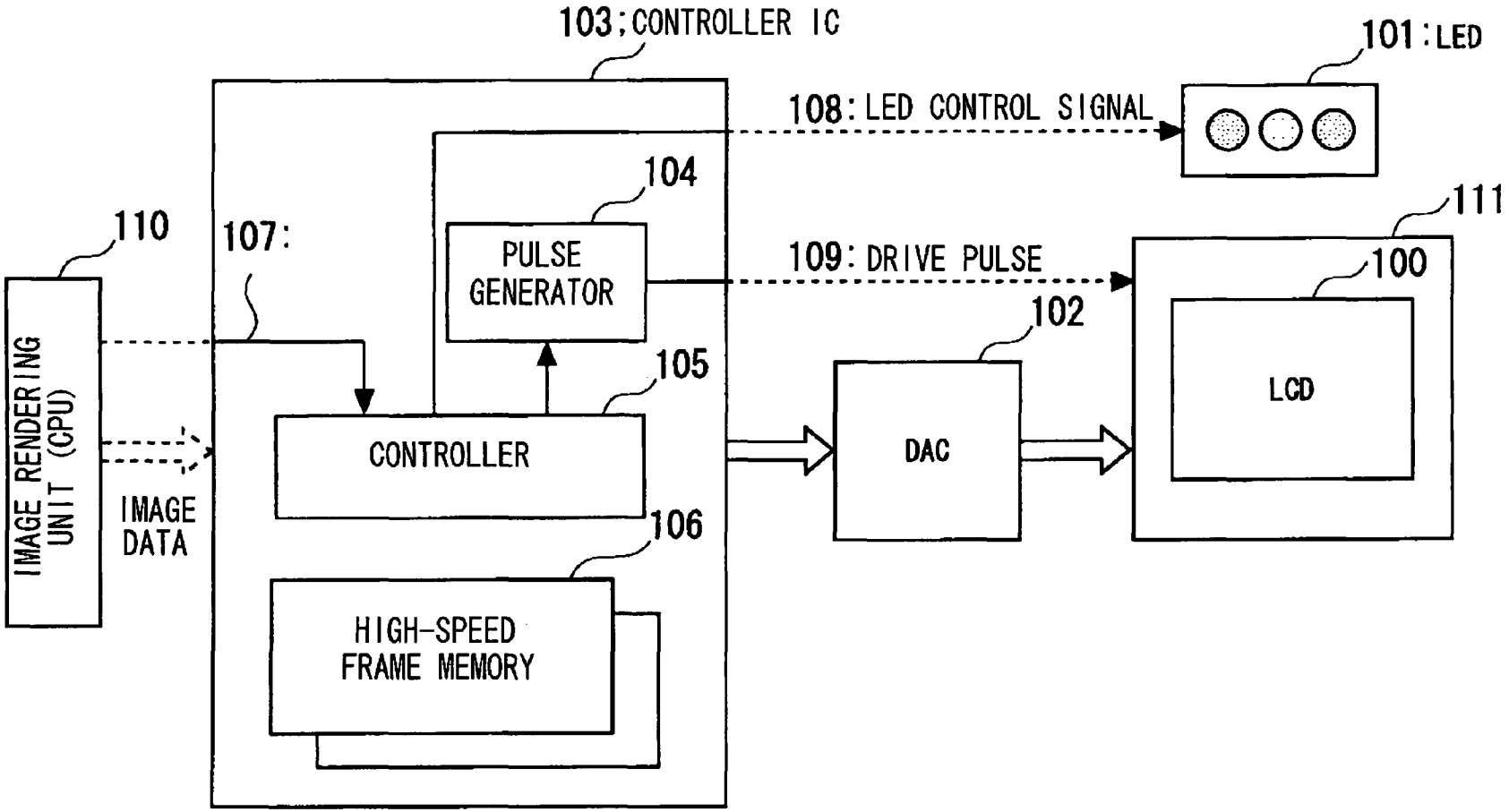
FIG. 6 is a schematic view illustrating the entirety of a field-sequential display system according to a first embodiment of the present invention.

By using the TFT panel thus fabricated, reset drive based upon a drive method in accordance with the above embodiments was performed. With this arrangement, 180-Hz color field-sequential drive was carried out. Backlighting using an LED was used as a color time-division light source. FIG. 6 is a schematic view illustrating the entirety of a color field-sequential display system according to a first embodiment of the present invention. A color field-sequential display system in which an RGB display is changed over and an additive mixture of color stimuli is employed to present an RGB display by one pixel, optical transmittance is realized without using a light absorbing body such as a color filter in the liquid crystal display panel. Three light sources (LEDs 101) for R, G, B emit light successively by time division based upon an LED control signal 108 output from a controller IC 103. Image data that has been transferred from an image rendering unit (CPU) 110 is accumulated in an amount equivalent to one frame in a frame memory 106 via a controller 105 within the controller IC 103 and the data that has been written to the frame memory 106 is applied to a pixel electrode. More specifically, an analog grayscale voltage corresponding to the data signal is output to a data line from a DAC (digital-to-analog converter) 102 in sync with a synchronizing signal 107, and the voltage is applied to the pixel electrode of the selected line of an LCD 100. A pulse generator 104 supplies drive pulses to a display unit 111.

In this example, the pixel pitch in the LCD panel 100 was 17.5 microns, and a display exhibiting a VGA (640×480) resolution was achieved in a display area of 0.55-inche diagonal length.

The fabricated color field-sequential liquid crystal display device exhibited an excellent response over a full range of temperatures and an excellent display was obtained.

EXAMPLE 2

In this example, use was made of a TFT array substrate employing a thin-film transistor of amorphous silicon. By using chromium (Cr) formed by sputtering, 480 gate bus lines (scanning electrode lines) and 640 drain bus lines (signal electrode lines) were formed to a line width of 7 μm, and silicon nitride (SiNx) was used as a gate insulating film.

The pixels had a unit size of 210 μm vertically and 210 μm horizontally, a TFT (thin-film transistor) was formed using amorphous silicon, and a pixel electrode was formed by sputtering using indium tin oxide (ITO), which is a transparent electrode.

Thus, a glass substrate on which TFTs were formed in an array was adopted as a first substrate. A light-shielding film consisting of chromium was formed on a second substrate opposing the first substrate. The liquid crystal material used was similar to that of Example 1.

By subjecting an image signal to overdrive and adopting the circuit arrangement of FIG. 5, a comparator arithmetic circuit for producing the image signal also is provided. A major increase in speed was achieved also in this example that employs overdrive using a TFT based upon amorphous silicon.

The effects of the embodiments will now be described.

In accordance with the embodiments, it is possible to realize a liquid crystal display device having a high-speed response in which delay ascribable to bounce is not a problem. The reason is that bounce is not allowed to occur.

In accordance with the embodiments, a high reliability in which an excellent displayed image can be achieved even if environmental temperature changes is obtained. The reason is speed of response of liquid crystal and the fact that an unstable orientation state such as bounce does not occur.

The present invention has been described in accordance with the foregoing embodiments. However, it goes without saying that the present invention is not limited solely to the structure of the embodiments and can be modified in various ways within the scope of the claims by those skilled in the art.

It should be noted that other objects, features and aspects of the present invention will become apparent in the entire disclosure and that modifications may be done without departing the gist and scope of the present invention as disclosed herein and claimed as appended herewith.

Also it should be noted that any combination of the disclosed and/or claimed elements, matters and/or items may fall under the modifications aforementioned.

What is claimed is:

1. A liquid crystal display device comprising:

a pair of supporting substrates;

at least one twisted nematic liquid crystal cell interposed between the pair of supporting substrates, about a 90 degrees-twisted orientation being realized between the supporting substrates to obtain the TN mode;

at least two electrodes associated with the twisted nematic liquid crystal cell, liquid crystal thereof being operated by an electric field applied across at least said two electrodes; and a circuit for performing reset for temporarily returning orientation of the liquid crystal to a predetermined state, wherein intensity of the electric field used in the reset is an intensity at which reset is obtained at a lower-limit temperature at which the device is used, and at which no bounce will occur in a response characteristic in the vicinity of room temperature, wherein the reset provides the predetermined state through an electric field near the side of a black image.

2. The device according to claim 1, wherein the intensity of the electric field used in the reset is a minimum intensity among intensities at which reset is obtained at the lower-limit temperature at which the device is used.

3. A liquid crystal display device comprising:

a pair of supporting substrates;

at least one twisted nematic liquid crystal cell interposed between the pair of supporting substrates, about a 90 degrees-twisted orientation being realized between the supporting substrates to obtain the TN mode;

at least two electrodes associated with the twisted nematic liquid crystal cell, liquid crystal thereof being operated by an electric field applied across at least said two electrodes; and a circuit for performing drive for raising speed of response by applying an electric field having an intensity greater than that of an electric field based upon a normal image signal across the electrodes, wherein the intensity of the electric field that is greater than that of the electric field based upon the normal image signal is an intensity at which a sufficient speed of response is obtained at a lower-limit temperature at which the device is used, and at which no bounce will occur in a response characteristic in the vicinity of room temperature.

4. The device according to claim 3, wherein the intensity of the electric field that is greater than that of the electric field based upon the normal image signal is a minimum intensity among intensities at which a sufficient speed of response is obtained at the lower-limit temperature at which the device is used.

5. The device according to claim 1, wherein in an interval in which reset is performed, the electric field used in the reset is an electric field having an intensity greater than that of an electric field at which a 95% response is obtained, and less than that of an electric field at which a 99.9% response is obtained, between a white image and a black image.

6. The device according to claim 5, wherein in the interval in which reset is performed, the electric field used in the reset is an electric field having an intensity greater than that of an electric field at which a 99% response is obtained, and less than that of an electric field at which a 99.9% response is obtained, between a white image and a black image.

7. The device according to claim 1, wherein in an interval in which an electric field having an intensity greater than that of an electric field based upon a normal image signal is applied, maximum intensity of the electric field having an intensity greater than that of the electric field based upon the normal image signal is greater than an intensity of an electric field at which a 95% response is obtained, and less than an intensity of an electric field at which a 99.9% response is obtained, between a white image and a black image.

8. The device according to claim 7, wherein in the interval in which the electric field having an intensity greater than that of the electric field based upon the normal image signal is applied, the maximum intensity of the electric field having an intensity greater than that of the electric field based upon the normal image signal is greater than an intensity of an electric field at which a 99% response is obtained, and less than an intensity of an electric field at which a 99.9% response is obtained, between a white image and a black image.

9. The device according to claim 1, wherein in an interval in which reset is performed, the electric field used in the reset is an electric field having an intensity greater than that of an electric field at which average tilt angle of the liquid crystal exceeds 75 degrees, and at which average tilt angle does not exceed 85 degrees.

10. The device according to claim 9, wherein in the interval in which reset is performed, the electric field used in the reset is an electric field having an intensity greater than that of an electric field at which average tilt angle of the liquid crystal exceeds 81 degrees, and at which average tilt angle does not exceed 85 degrees.

11. The device according to claim 1, wherein in an interval in which an electric field having an intensity greater than that of an electric field based upon a normal image signal is applied, maximum intensity of the electric field having an intensity greater than that of the electric field based upon the normal image signal is an intensity of an electric field at which average tilt angle of the liquid crystal exceeds 75 degrees, and at which average tilt angle does not exceed 85 degrees.

12. The device according to claim 11, wherein in the interval in which an electric field having an intensity greater than that of an electric field based upon a normal image signal is applied, the maximum intensity of the electric field having an intensity greater than that of the electric field based upon the normal image signal is an intensity of an electric field at which average tilt angle of the liquid crystal exceeds 81 degrees, and at which average tilt angle does not exceed 85 degrees.

13. A method of driving a liquid crystal display device having at least one twisted nematic liquid crystal cell interposed between a pair of supporting substrates for operating the liquid crystal by an electric field applied across at least two electrodes, about a 90 degrees-twisted orientation being realized between the supporting substrates to obtain the TN mode, said method comprising the steps of:

in performing reset for temporarily returning orientation of the liquid crystal to a predetermined state, making the intensity of the electric field used in the reset as an intensity at which reset is obtained at a lower-limit temperature at which the device is used; and making the intensity of the electric field used in the reset as an intensity at which no bounce will occur in a response characteristic in the vicinity of room temperature, wherein the reset provides the predetermined state through an electric field near the side of a black image.

14. The method according to claim 13, wherein the intensity of the electric field used in the reset is made a minimum intensity among intensities at which reset is obtained at the lower-limit temperature at which the device is used.

15. A method of driving a liquid crystal display device having at least one twisted nematic liquid crystal interposed between a pair of supporting substrates for operating the liquid crystal by an electric field applied across at least two electrodes, about a 90 degrees-twisted orientation being realized between the supporting substrates to obtain the TN mode, said method comprising the steps of:

in performing drive for raising speed of response by applying an intensity of the electric field greater than that of an electric field based upon a normal image signal across the electrodes, making intensity of the electric field that is greater than that of an electric field based upon a normal image signal as an intensity at which a sufficient speed of response is obtained at a lower-limit temperature at which the device is used; and making the intensity of the electric field that is greater than that of an electric field based upon a normal image signal as an intensity at which no bounce will occur in a response characteristic in the vicinity of room temperature.

16. The method according to claim 15, wherein the intensity of the electric field that is greater than that of the electric field based upon the normal image signal is made a minimum intensity among intensities at which a sufficient speed of response is obtained at the lower-limit temperature at which the device is used.

17. The method according to claim 13, wherein in an interval in which reset is performed, the electric field used in the reset is made an electric field having an intensity greater than that of an electric field at which a 95% response is obtained, and less than that of an electric field at which a 99.9% response is obtained, between a white image and a black image.

18. The method according to claim 17, wherein in the interval in which reset is performed, the electric field used in the reset is made an electric field having an intensity greater than that of an electric field at which a 99% response is obtained, and less than that of an electric field at which a 99.9% response is obtained, between a white image and a black image.

19. The method according to claim 13, wherein in an interval in which an electric field having an intensity greater than that of an electric field based upon a normal image signal is applied, maximum intensity of the electric field having an intensity greater than that of the electric field based upon the normal image signal is made greater than an intensity of an electric field at which a 95% response is obtained, and less than an intensity of an electric field at which a 99.9% response is obtained, between a white image and a black image.

20. The method according to claim 17, wherein in the interval in which the electric field having an intensity greater than that of the electric field based upon the normal image signal is applied, maximum intensity of the electric field having an intensity greater than that of the electric field based upon the normal image signal is made greater than an intensity of an electric field at which a 99% response is obtained, and less than an intensity of an electric field at which a 99.9% response is obtained, between a white image and a black image.

21. The method according to claim 13, wherein in an interval in which reset is performed, the electric field used in the reset is made an electric field having an intensity greater than that of an electric field at which average tilt angle of the liquid crystal exceeds 75 degrees, and at which average tilt angle does not exceed 85 degrees.

22. The method according to claim 21, wherein in the interval in which reset is performed, the electric field used in the reset is made an electric field having an intensity greater than that of an electric field at which average tilt angle of the liquid crystal exceeds 81 degrees, and at which average tilt angle does not exceed 85 degrees.

23. The method according to claim 13, wherein in an interval in which an electric field having an intensity greater than that of an electric field based upon a normal image signal is applied, maximum intensity of the electric field having an intensity greater than that of an electric field based upon a normal image signal is made greater than an intensity of an electric field at which average tilt angle of the liquid crystal exceeds 75 degrees, and at which average tilt angle does not exceed 85 degrees.

24. The method according to claim 23, wherein in the interval in which the intensity of the electric field having an intensity greater than that of an electric field based upon a normal image signal is applied, maximum intensity of the electric field having an intensity greater than that of the electric field based upon the normal image signal is made an electric field having an intensity greater than that of an electric field at which average tilt angle of the liquid crystal exceeds 81 degrees, and at which average tilt angle does not exceed 85 degrees.

25. A near-eye apparatus having a liquid crystal display device set forth in claim 1.

26. A projector apparatus for projecting an original image of a liquid crystal display device using a projection optical system, said apparatus having a liquid crystal display device set forth in claim 1.

27. A mobile terminal having a liquid crystal display device set forth in claim 1.

28. A liquid crystal monitor apparatus having a liquid crystal display device set forth in claim 1.

29. A liquid crystal display unit for a vehicle, said display unit having a liquid crystal display device set forth in claim 1.

* * * * *